US005589858A

United States Patent [19]

Kadowaki et al.

[11] Patent Number: 5,589,858

[45] Date of Patent: Dec. 31, 1996

[54] INFORMATION RECORDING APPARATUS

[75] Inventors: Hidejiro Kadowaki; Hiroshi Sugiyama, both of Yokohama; Yasuhiko Ishida, Tokyo; Makoto Takamiya, Kawasaki, all of Japan

[73] Assignee: Canon Kabushiki Kaisha, Tokyo, Japan

[21] Appl. No.: 213,998

[22] Filed: Mar. 15, 1994

Related U.S. Application Data

[63] Continuation of Ser. No. 714,378, May 22, 1991, abandoned.

[30] Foreign Application Priority Data

May 22, 1990 [JP] Japan ..... 2-132887
May 22, 1990 [JP] Japan ..... 2-132891

[51] Int. Cl.[6] ..... B41J 29/38
[52] U.S. Cl. ..... 347/14; 347/117; 356/28.5
[58] Field of Search ..... 346/140 PD; 250/561; 356/28.5; 347/133, 117, 14

[56] References Cited

U.S. PATENT DOCUMENTS

| | | | |
|---|---|---|---|
| 4,312,007 | 1/1982 | Winfield | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,470,696 | 9/1984 | Ballard | 356/28.5 |
| 4,558,333 | 12/1985 | Sugitani et al. | 346/140 R |
| 4,575,739 | 3/1986 | De Schamphelaere et al. | 346/160 |
| 4,670,761 | 6/1987 | Yoshino et al. | 346/75 |
| 4,698,649 | 10/1987 | Lee | 346/108 |
| 4,704,675 | 11/1987 | Jacobs et al. | 346/140 R |
| 4,723,129 | 2/1988 | Endo et al. | 346/1.1 |
| 4,740,796 | 4/1988 | Endo et al. | 346/1.1 |
| 4,872,028 | 10/1989 | Lloyd | 346/140 R X |
| 4,948,257 | 8/1990 | Kaufman et al. | 356/354 |
| 5,157,460 | 10/1992 | Hino | 356/365 |
| 5,216,478 | 6/1993 | Kadowaki et al. | 356/28.5 |
| 5,229,830 | 7/1993 | Ishida et al. | 356/28.5 |

FOREIGN PATENT DOCUMENTS

| | | |
|---|---|---|
| 0127244 | 12/1984 | European Pat. Off. . |
| 0226878 | 7/1987 | European Pat. Off. . |
| 0391278 | 10/1990 | European Pat. Off. . |
| 57-197486 | 12/1982 | Japan . |
| 58-005260 | 1/1983 | Japan . |
| 59-123670 | 7/1984 | Japan . |
| 59-138461 | 8/1984 | Japan . |
| 60-076357 | 4/1985 | Japan . |
| 63-231469 | 4/1985 | Japan . |
| 60-071260 | 4/1985 | Japan . |
| 62-233252 | 10/1987 | Japan . |
| 63-12568 | 1/1988 | Japan . |
| 54-056847 | 5/1989 | Japan . |
| 1-266567 | 10/1989 | Japan . |
| 2-80269 | 3/1990 | Japan . |
| 2-262064 | 10/1990 | Japan . |

*Primary Examiner*—Nestor Ramirez
*Attorney, Agent, or Firm*—Fitzpatrick, Cella, Harper & Scinto

[57] ABSTRACT

In an apparatus wherein a recording medium is conveyed by a conveying system with the front surface of the recording medium opposed to recording heads and information is recorded on the recording medium by liquid droplet jet, a first speed meter is provided on the back side of the recording medium and further, a second speed meter for detecting liquid droplet jet speed together with the first speed meter is provided at a predetermined location, whereby the recording position is adjusted. The first and second speed meters may preferably be optical Doppler velocimeters which will not cause any speed detection error with fluctuation of the wavelength of a light source.

17 Claims, 16 Drawing Sheets

INFORMATION RECORDING APPARATUS

This application is a continuation of application Ser. No. 07/714,378 filed May 22, 1991, now abandoned.

BACKGROUND OF THE INVENTION

1. Field of the Invention

This invention relates to an apparatus for causing recording liquid to be discharged, for example, from a full line recording head of recording medium width to a recording medium being conveyed by feeding means, thereby accomplishing the recording of information such as characters and images.

2. Description of the Prior Art

A serial type recording apparatus and a full line type recording apparatus are known as ink jet recording apparatuses of this kind for causing recording liquid to be discharged from a recording head to thereby accomplish the recording of information such as characters and images.

The serial type recording apparatus is of a form in which recording is effected by a recording head carried on a carriage while the carriage is moved along a platen holding a recording medium and sheets are fed in a direction perpendicular to the direction of movement of the carriage, and the full line type recording apparatus is of a form in which a recording head is provided with ink discharge ports disposed over the recording width in the main scanning direction and such a recording medium is moved in a sub-scanning direction relative to a recording head to thereby effect recording.

There has also been proposed an apparatus which assumes one of the above-described forms and yet is constructed so that by a plurality of recording heads being disposed, not only monochromatic recording but also color recording can be accomplished.

Referring to FIG. 1A of the accompanying drawings which illustrates the conveyance control mechanism of an ink jet recording apparatus according to the prior art, the reference numeral 51 designates a cut sheet which is a recording medium and which is conveyed in the direction of arrow after the writing timing in the sub-scanning direction is taken by register rollers 52.

The reference numeral 53 denotes paper keep rollers which limit the movement of the cut sheet 51 placed on a conveying belt 54. The reference numeral 55 designates a driving roller on which the conveying belt 54 is wound with predetermined tension. The reference numeral 56 denotes a charger which causes the cut sheet 51 on the conveying belt 54 to be electrostatically attracted to the conveying belt 54.

The reference numeral 57 designates a paper discharge tray onto which the cut sheet 51 after recording is discharged. The reference numerals 58–61 denote image buffers which memorize recording information data. Color data corresponding to various colors, i.e., yellow, magenta, cyan and black, are memorized in the image buffers 58–61, respectively, on the basis of a writing control signal from a controller 62. The controller 62 reads out the respective color data from the image buffers 58–61 at predetermined intervals after the register rollers 52 are driven, puts out the color data to recording heads 63–66, respectively, and records each color image on the cut sheet 51. The reference numerals 67–70 designate memory control lines which transfer the writing control signal from the controller 62 to the image buffers 58–61. The reference numerals 71, 73, 75 and 77 denote data lines which transfer the color data read out from the image buffers 58–61 to the recording heads 63–66. The reference numerals 72, 74, 76 and 78 designate recording control lines which transfer the recording timing signal output from the controller 62 to the recording heads 63–66.

The reference numeral 79 denotes a start signal output from a host, not shown.

The recording operation will now be described.

In a recording apparatus having a plurality of recording heads 63–66 thus disposed therein, when the cut sheet 51 is fed after the image recording timing in the sub-scanning direction is taken by the register rollers 52, the cut sheet 51 is attracted to the conveying belt 54 by means of the charger 56 and is conveyed. When together with this, a recording operation start command is output to the controller 62 by a start signal 79, image data (color data) is read out from the image buffer 61 to the recording head 66 which is a first recording head at a timing whereat recording is effected from the head of the cut sheet 51, and recording is started on the cut sheet 51 by the recording head 66.

Likewise, for the recording heads 65–63 which are second to fourth recording heads, a timing corresponding to the distance to the immediately preceding head is taken, and the image data read out from the image buffers 60–58 for respective colors are recorded on the cut sheet 51 by the recording heads 65–63 for respective colors, and as a result, a full color image is formed on the cut sheet 51, which is then discharged onto the paper discharge tray 57.

Now, on the conveying belt 54 for conveying the cut sheet 51 which is a recording medium, there may occur a periodic or non-periodic fluctuation in the conveyance speed of the cut sheet 51 as shown in FIG. 1B of the accompanying drawings, due to the irregularity of the thickness of the belt created in the manufacturing process thereof and the irregularity of the circularity of the driving roller 55 or the fluctuation of the driving load thereof.

FIG. 1B is a graph illustrating the speed irregularity characteristic of the conveying belt 54, and in this graph, the ordinate represents the belt speed and the abscissa represents time.

In this figure, I indicates the speed curve, T indicates a period corresponding to one round of the belt, and H indicates the maximum amount of speed fluctuation.

As can be seen from this figure, the speed of the conveying belt 54 shifts to the plus side (acceleration) and the minus side (deceleration) with respect to the normal standard conveyance speed $V_0$, due to the irregularity of the thickness of the conveying belt 54 created in the manufacturing process thereof and the irregularity of the circularity of the driving roller 55 or the fluctuation of the driving load thereof. As a result, the time required from after the cut sheet 51 is conveyed from the register rollers 52 until the cut sheet 51 arrives between the recording heads 66–63 becomes irregular, and the writing timing of each of the recording heads 66–63 deviates thus causing density irregularity and misregistration of the image.

Particularly in the case of a color image, any minute color misregistration would cause the bleeding of colors, which in turn has led to the serious problem that the quality of the color image is remarkably deteriorated.

In order to solve this, in Japanese Patent Application No. 231469/1988 filed on Sep. 17, 1988, there is disclosed an apparatus in which the conveyance speed condition of conveying means for conveying a recording medium is detected and the recording timing of recording means is adjusted on the basis of the detected conveyance speed condition.

Also, U.S. application Ser. No. 501,499 (European Application Serial No. 90106169) discloses a non-contact Doppler velocimeter which is made compact as velocity detecting means and which does not cause any measurement error by the fluctuation of the wavelength of a light source, and discloses adjusting the recording timing of recording means on the basis of the detected conveyance speed condition. A velocimeter similar to the above-described non-contact Doppler velocimeter is disclosed in U.S. Pat. No. 4,948,257. Further, Japanese Laid-Open Patent Application No. 5260/1983 discloses the technique of finding discharge speed from the passage time of a liquid droplet passing between two points and achieving the stabilization of discharge.

SUMMARY OF THE INVENTION

It is an object of the present invention to provide an information recording apparatus which is not affected by recording liquid or the like on the surface side of a recording medium.

It is also an object of the present invention to provide an improved information recording apparatus in which no detection error occurs in the edge level difference portion of the leading end or the trailing end of a cut sheet.

It is another object of the present invention to provide an information recording apparatus in which silver halide film as a recording medium is not sensitized because of the optical detection of conveyance speed.

It is still another object of the present invention to provide a more improved liquid jet recording apparatus in which the conveyance speed condition of a recording medium and the discharge speed condition of a liquid droplet from a recording head are detected.

DESCRIPTION OF THE PREFERRED EMBODIMENTS

Making the recording position constant by recording timing control will hereinafter be described with reference to FIG. 2A, and making the recording position constant by conveyance speed control will hereinafter be described with reference to FIGS. 2B and 2C.

Figure 2A:
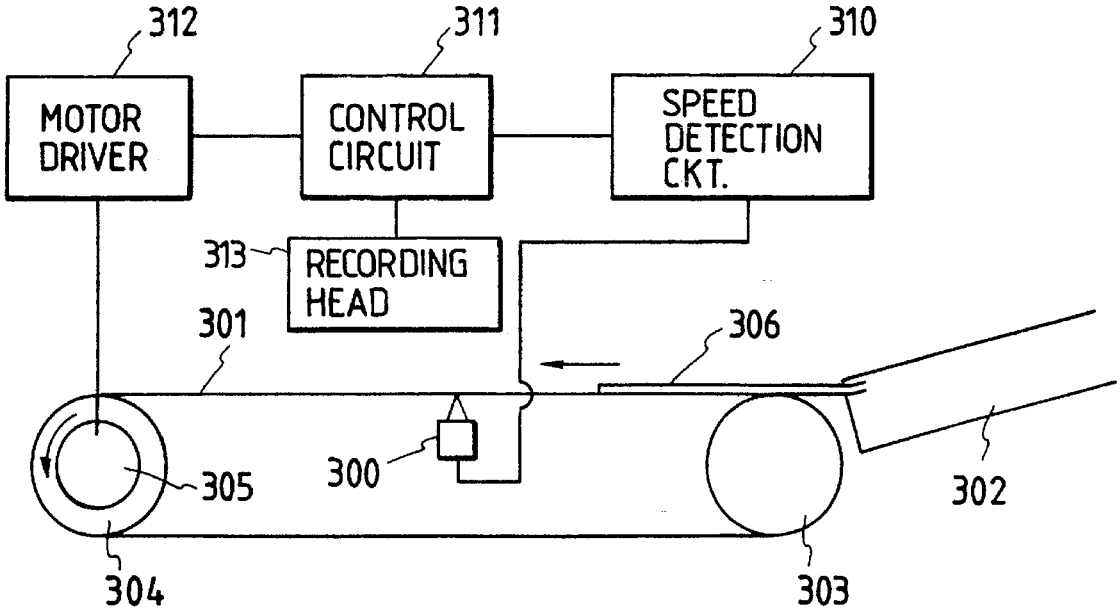
FIG. 2A shows an embodiment of making the recording position constant by recording timing control.

In FIG. 2A, a speed meter 300 provided on the back side of a belt 301 which is conveying means is used for the recording timing control of a recording head 313.

The reference numeral 301 designates a belt on which recording paper 306 is placed, the reference numeral 302 denotes a paper supply unit for supplying the paper 306 onto the belt 301, the reference numerals 303 and 304 designate a belt roller journalled to an apparatus body and a driving roller, respectively, and the reference numeral 305 denotes a drive motor on which the driving roller 304 is mounted.

The belt 301 is extended as shown between the driving roller 304 and the belt roller 303, and the driving roller 304 is rotated in the direction of arrow by the drive motor 305 through a drive motor driver 312, thereby moving the belt 301.

The paper 306 supplied from the paper supply unit 302 is placed on the belt 301 and is moved in the direction of arrow with the movement of the belt 301. The speed meter 300 is such that a laser beam is applied to the back of the belt 301 being moved and reflected scattered light from the irradiated position on the belt 301 is received by a light detector.

The output signal from the light detector of the speed meter 300 is input to a speed detection circuit 310. The circuit 310 detects the movement speed of the belt 301 on the basis of the frequency of the output signal from the light detector. The information of the speed detected by the circuit 310 is input to a control circuit 311, which controls the recording timing of a recording head 313 for recording an image on the paper 306. For example, when it is recognized that the conveyance speed exceeds the normal standard conveyance speed Vo, the image recording timing of the recording head 313 is quickened, and when it is recognized that the conveyance speed is lower than the normal standard conveyance speed Vo, the image recording timing of the recording head 313 is delayed. By such control of the recording timing by the control circuit 311, the dot pattern with respect to the sub-scanning direction is made constant in pitch, and a very good image can be recorded on the paper 306.

Figure 2B:
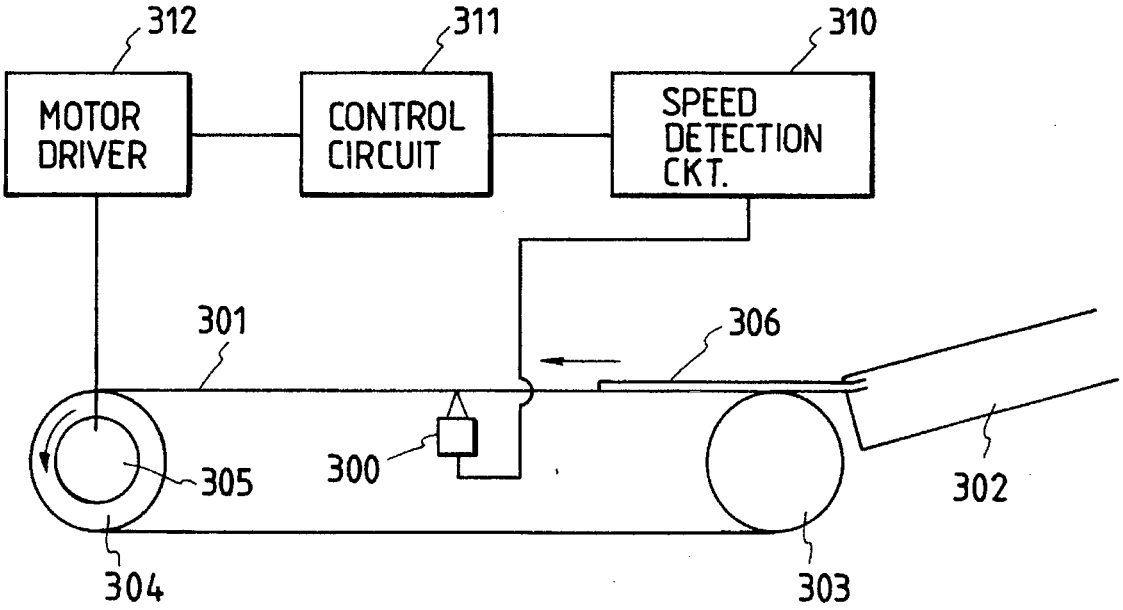
FIGS. 2B and 2C show an embodiment of making the recording position constant by the conveyance speed control of a belt and film.

FIG. 2B shows an embodiment for making the recording position constant by conveyance speed control. In FIG. 2B, reference numerals identical to those in FIG. 2A designate identical members. In FIG. 2B, the information of the speed detected by the circuit 310 is input to the control circuit 311, which controls the rotational speed of the drive motor 305 through the drive motor driver 312. This control is such that the circuit 311 inputs a correction signal to the driver 312 so that the movement speed of the belt 301, i.e., the movement speed of the paper 306, may become constant, and in response to this signal, the driver 312 adjusts the rotational speed of the drive motor 318. Thereby, the feeding speed of the paper 306 becomes substantially constant, and the periodic variation in the speed of the belt 301 due to the eccentricity of the driving roller which has heretofore occurred when only the control of the number of rotations of the driving roller has been effected can be cancelled, and paper feeding at a constant speed can be accomplished more reliably.

Also, the speed meter of the present invention is very compact and is small in number of parts as previously described and therefore is low in cost and thus, can also be effectively used in an image recording apparatus such as a facsimile apparatus.

In FIG. 2B, images are written onto the paper 306 fed at a constant speed, by a recording head, not shown. In the present embodiment, the writing of images is effected while the paper 306 is moved very accurately (in the sub-scanning direction, during the image writing and therefore, printing of good quality becomes possible.

Figure 2C:
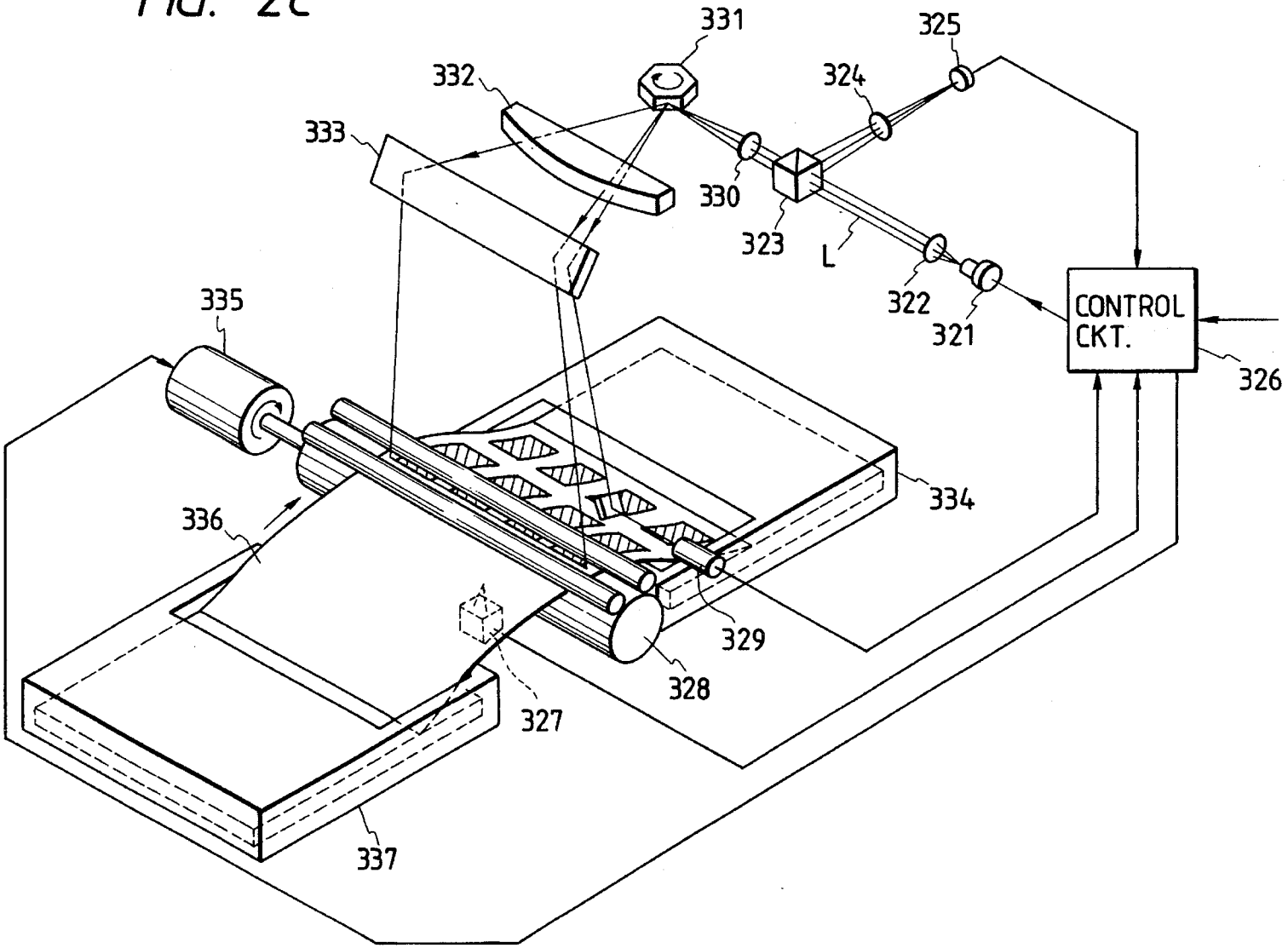

Here, as shown in FIG. 2C, silver halide film may be provided instead of the paper 306, and laser scanning recording may be effected on the surface (emulsion surface) of the film and the back of the film may be speed-detected. If this is done, the problem that when the surface of the film is to be optically speed-detected, the emulsion surface of the film on which information is to be recorded is sensitized because of the speed detection will be eliminated.

That is, with reference to FIG. 2C, description will hereinafter be made of a laser printer for medical treatment which is often used in the field of medical treatment or the like and which records and outputs a highly accurate multiharmonic monochromatic half-tone image onto film.

In FIG. 2C, the reference numeral 321 designates a semiconductor laser, and the reference numeral 322 denotes an optical system such as a collimator lens which collimates the light from the semiconductor laser 321. The reference numeral 323 designates a beam splitter, the reference numeral 324 denotes a condensing lens, and the reference numeral 325 designates a photo-diode which monitors the intensity of the laser beam divided by the beam splitter 323. The reference numeral 326 denotes a control circuit which effects the control of the entire apparatus, and also effects the modulation and driving of the semiconductor laser and the control of sub-scanning of the laser. As the method of modulating the semiconductor laser, pulse width modulation or intensity modulation is effected on the basis of a picture element density signal or modulation is effected by the method described in Japanese Patent Application No. 243711/1989.

On the other hand, a lens 330 and a rotatable polygon mirror 331 which is deflecting means for effecting the main scanning are disposed in the direction of rectilinear transmission of the beam splitter 323. The reference numeral 332 designates an fθ lens for the correction of inclination, and the reference numeral 333 denotes a turn-back mirror which turns the direction of the light beam to the surface (emulsion surface) of film 336 which is a recording medium. The reference numeral 337 designates a supply magazine containing a number of sheets of unused film therein, and the reference numeral 334 denotes a receive magazine containing sensitized film therein. The film is contained with the emulsion surface thereof facing upward. The reference numeral 335 designates a motor for effecting the sub-scanning. The rotational speed of the motor 335 is controlled by a command from the control circuit 326. The reference numeral 328 denotes a roller connected to the motor 335 to effect the sub-scanning of the film 336. The reference numeral 327 designates a Doppler velocimeter disposed on the back side of the film. The Doppler velocimeter 327 applies a laser beam to the back (non-emulsion surface) of the film 336 and detects scattered light subjected to Doppler shift to thereby measure the conveyance speed of the film 336 in a non-contact manner. Since it applies the laser beam to the nonemulsion surface, the Doppler velocimeter can detect the conveyance speed without sensitizing the film. The output of the Doppler velocimeter 327 is connected to the control circuit 326. The film 326 is taken out of the supply magazine 337 by a taking-out mechanism, not shown, and is fed to the roller 328, and the sub-scanning of the film 336 is effected at a low speed by the roller 328. At this time, the control circuit 326 monitors the output of the Doppler velocimeter 327, and controls the rotational speed of the motor 335 so that said output may become constant. By forming such a feedback loop, highly accurate sub-scanning can be accomplished. The sub-scanning speed of the film is directly detected by the Doppler velocimeter and therefore, even when there is mounting eccentricity in the roller 328 or when the circularity of the roller 328 itself is not good, highly accurate sub-scanning free of irregularity can be realized without being affected thereby. Simultaneously with the sub-scanning, the main scanning is effected by the rotation of the rotatable polygon mirror 331, and a latent image is two-dimensionally recorded on the film 336 by the modulated laser beam. In the laser printer for medical treatment according to the present embodiment, it is usual to effect multiformat outputting of a diagnostic image for medical treatment in a predetermined arrangement. The film thus recorded is received in the receive magazine 334. Although not shown, there is provided a developing device for automatically developing the recorded film so that the recorded film can be selectively fed to one of the receive magazine 334 and the developing device. The reference numeral 329 designates a photodetector for providing a signal (BD signal) representative of the beginning of the main scanning for taking synchronism during each main scanning. The control circuit 326 modulates and drives the semiconductor laser 321 in conformity with a picture element signal to be recorded while taking synchronism by the output of the photodiode 329. The timing for beginning to depict each scanning line is obtained on the basis of the BD signal and therefore, to depict a highly accurate image, it is necessary that the BD signal be obtained at the most accurate possible timing. So, the semiconductor laser 321 is designed to oscillate continuously at a predetermined output when the scanning light beam passes through the photodetector 329 to thereby detect the signal. In FIGS. 2A, 2B and 2C, the speed meter 300 may be based on any non-contact type, and, for example, a well-known laser Doppler velocimeter is applicable as such speed meter. The use of a laser Doppler velocimeter of a new type which will hereinafter be described is more preferable.

Figure 1A:
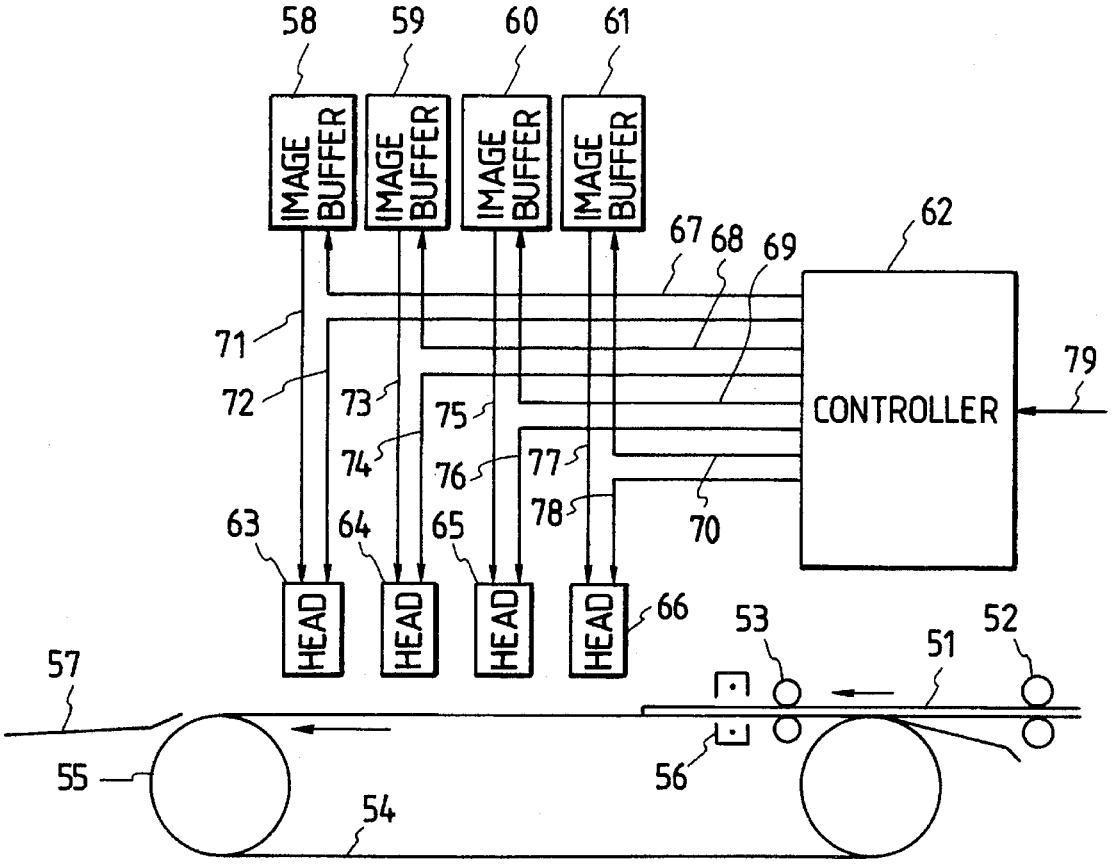
FIG. 1A PRIOR ART
FIG. 1A illustrates the conveyance control mechanism of a recording apparatus according to the prior art.
Figure 1B:
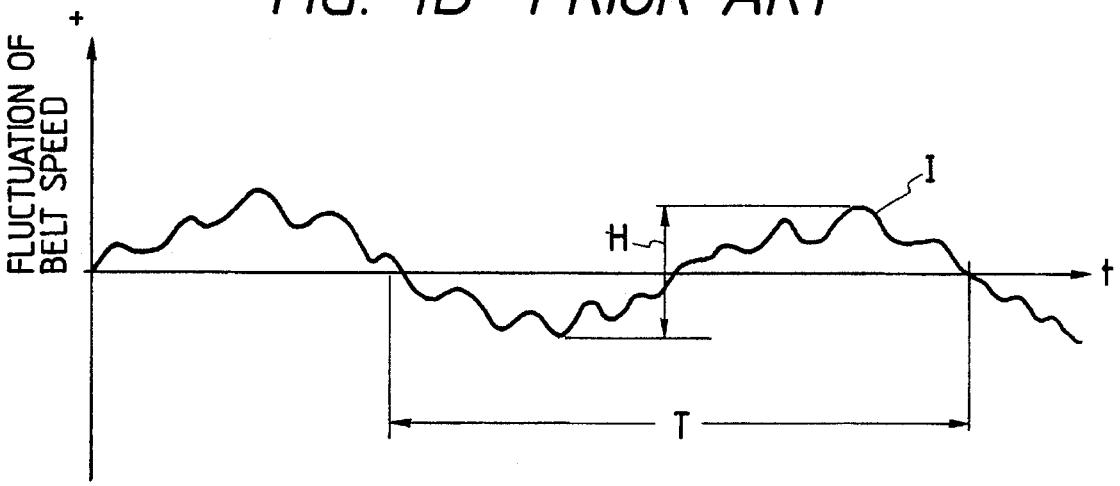
FIG. 1B PRIOR ART
FIG. 1B is a graph illustrating the speed irregularity characteristic of a conveying belt.
Figure 3:
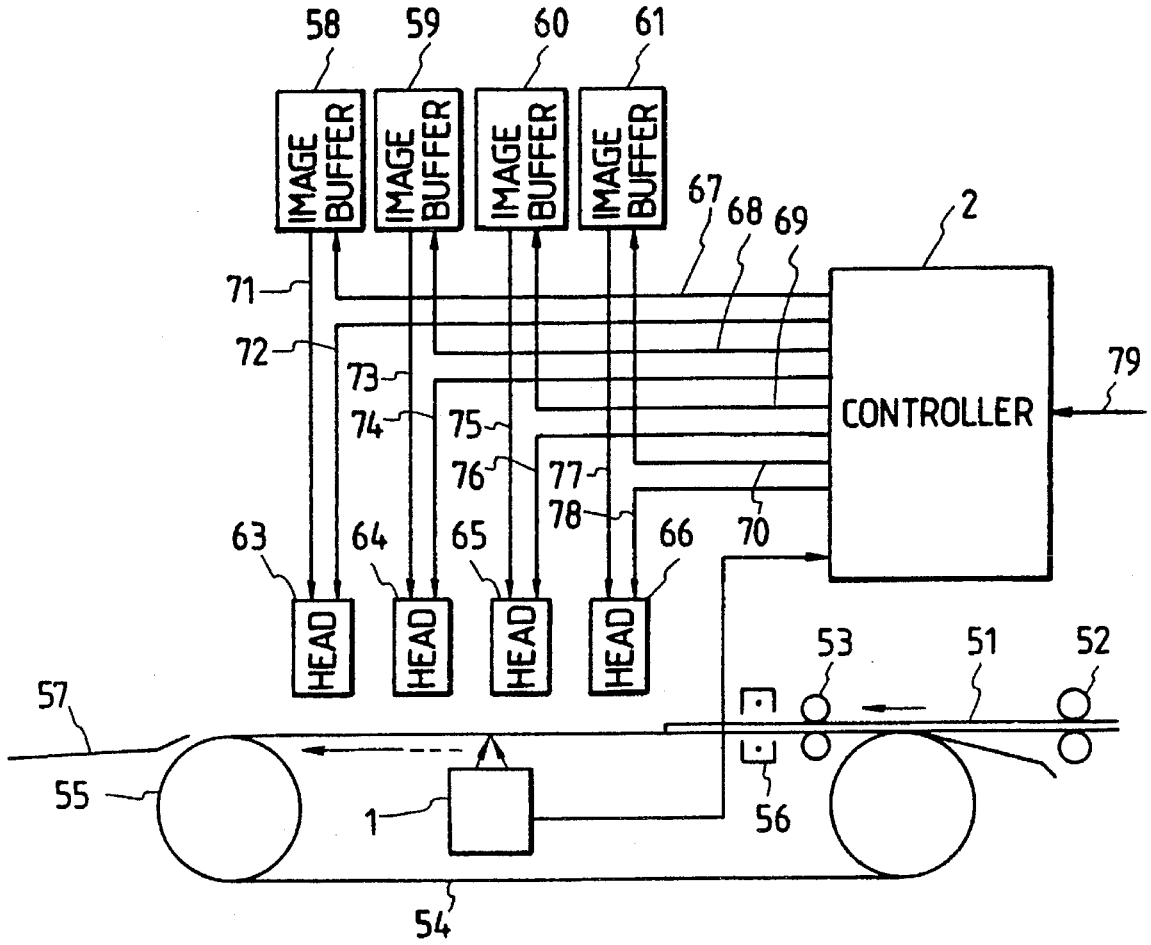
FIG. 3 shows an embodiment of an ink jet recording apparatus capable of accomplishing color recording.

FIG. 3 shows an embodiment of an ink jet recording apparatus capable of accomplishing color recording, and in this figure, the same members as those in FIG. 1 are given the same reference numerals. In FIG. 3, the reference numeral 1 designates a speed detector of the laser Doppler type in which a semiconductor laser is used as a light source, whereby compactness is achieved. This speed detector 1 is provided at a location upstream of a driving roller 55 and substantially central in the widthwise direction of a conveying belt 54 on the inner peripheral side of the conveying belt 54. The reference numeral 2 denotes a controller which serves also as recording timing adjusting means and which, when the speed detector 1 detects the conveyance speed of the conveying belt 54 which is conveying means, calculates the movement distance of the conveying belt 54 from the output of the speed detector 1 as will be described later, makes image writing timing of recording heads 63–66, and makes the registrations of respective color images coincident with one another so that regular image writing can be done without resorting to the irregularity of the speed of the conveying belt 54, thus forming an image free of density irregularity, color irregularity and bleeding of colors.

Figure 4:
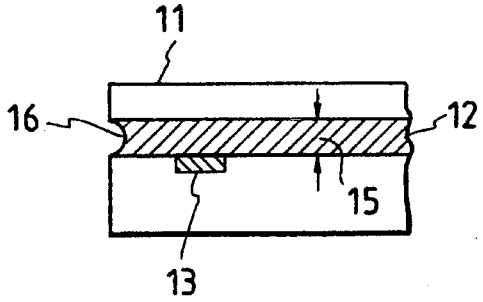
FIGS. 4 and 5 are a cross-sectional view illustrating the construction of a recording head shown in FIG. 3 and an illustration of the principle of ink discharge thereof, respectively.
Figure 5:
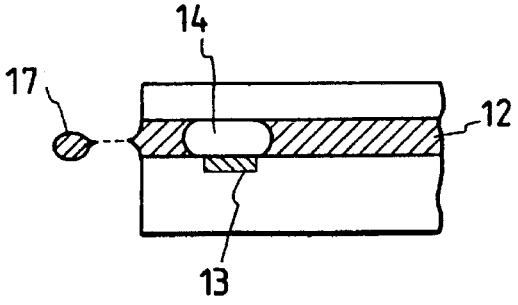

FIGS. 4 and 5 are a cross-sectional view of the recording heads 63–66 shown in FIG. 3 and an illustration of the principle of ink discharge thereof, respectively, and show, for example, the case of recording heads of the bubble jet type.

In these figures, the reference numeral 11 designates the head body, and heat is applied to recording ink 12 in conformity with electrical energy input from a heat generating member 13. The reference numeral 14 denotes a bubble.

When heat conforming to electrical energy input to the heat generating member 13 is given to the recording ink 12, a bubble 14 is created in a discharge port 15 and an ink droplet 17 is discharged from a discharge port 16 to the surface of a recording medium by the bubble 14.

In this embodiment, the head bodies 11 are arranged in a row on the basis of printing resolution, e.g. 400 DPI, so as to form a full line in the widthwise direction of A4 format, and the printing of 3360 dots is possible with respect to the main scanning direction.

The operation of adjusting the writing starting timing of the recording heads 63–66 shown in FIG. 3 will now be described with reference to FIGS. 6 and 7.

Figure 6:
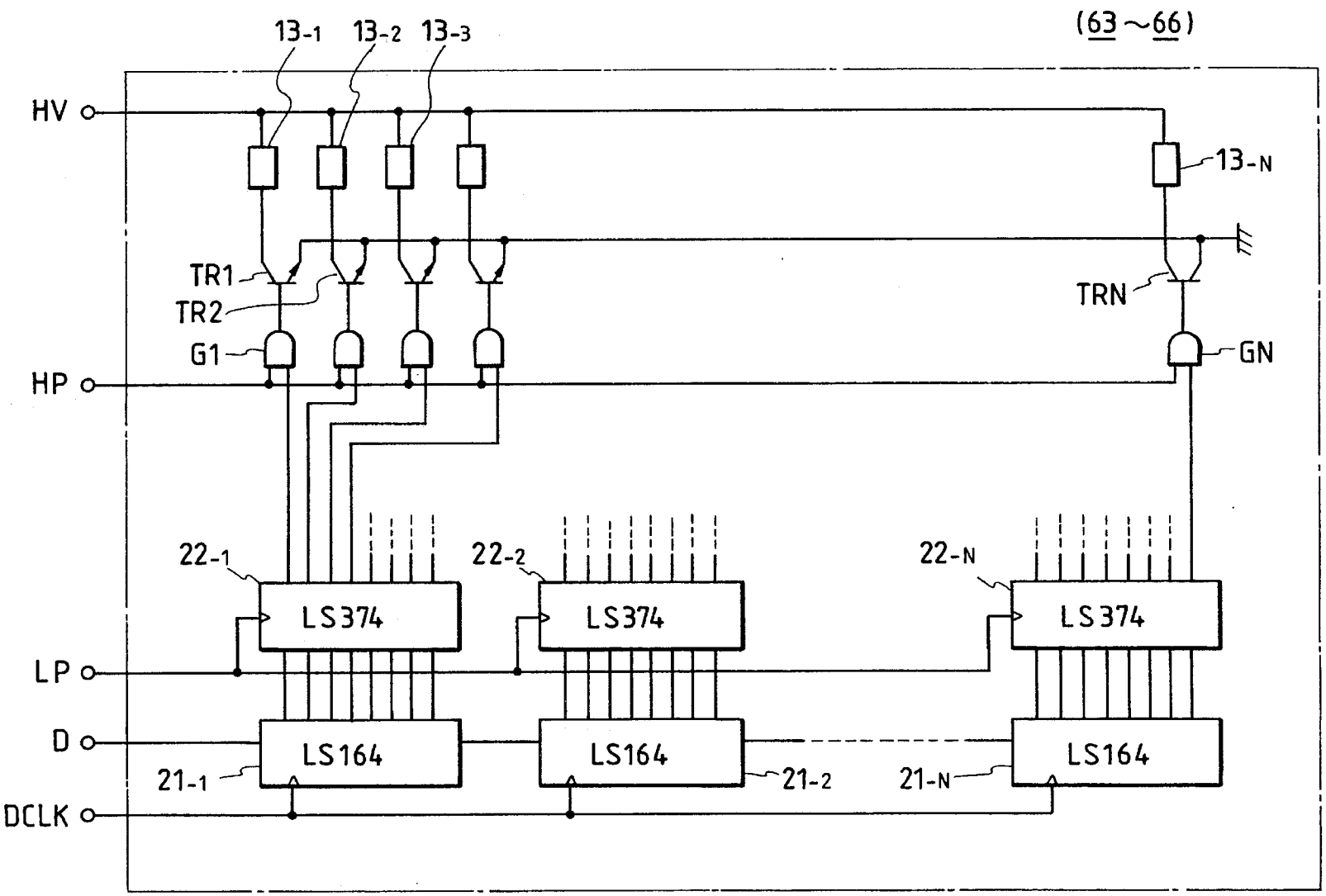
FIG. 6 is a diagram of a driving circuit for a bubble jet recording head comprising the head body shown in FIG. 4.

FIG. 6 is a diagram of a driving circuit for the bubble jet recording heads comprising the head bodies 11 shown in FIG. 4. In FIG. 6, the reference characters 13-1 to 13-N designate heat generating members which correspond in number to 3360 dots. One end of each heat generating member is connected to a heater voltage source HV and the other end is connected to the collector side of switching transistors TR1–TRN. The outputs of AND gates G1–GN are input to the base side of the switching transistors TR1–TRN. The AND gates G1–GN take the AND of heat pulse HP and the latch outputs of latch circuits 22-1 to 22-N, and ON/OFF-control the switching transistors TR1–TRN by the AND outputs thereof.

Denoted by 21-1 to 21-N are shift registers which successively transfer data D corresponding to one line stored in each image buffer 58–61, i.e., 3360 dots, while keeping synchronism with data clock DCLK. The latch circuits 22-1 to 22-N latch up the data D transferred to the shift registers 21-1 to 21-N in synchronism with latch pulse LP.

Figure 7:
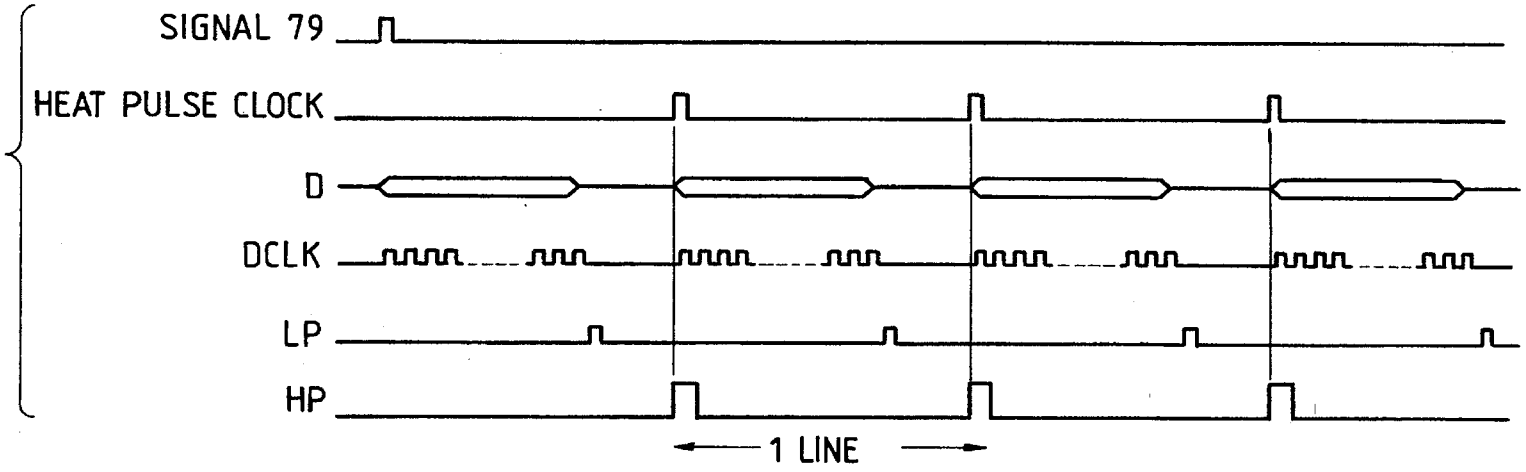
FIG. 7 is a timing chart illustrating the operation of the circuit of FIG. 6.

FIG. 7 is a timing chart illustrating the operation of the circuit of FIG. 6, and in FIG. 7, reference characters identical to those in FIG. 6 are identical in significance to those in FIG. 6.

When the data D is read out from the image buffer 61 by a start signal 79 produced from the controller 2 through a memory control line 70, this data D is input to the shift registers (e.g. LS164) 21-1 to 21-N incorporated in the recording head 66 through a data line 77, and data D corresponding to one scan, i.e., 3360 dots, are successively transferred. When the data D corresponding to one scan have been transferred, latch pulse LP is input from the controller 2 through a recording control line 78 and is latched by latch circuits (e.g. LS374) 22-1 to 22-N likewise incorporated in the recording head 66.

In the controller 2, the output of the speed detector 1 is counted and a heat pulse clock is made, and at that timing, the heat pulse HP is input to the recording head 66 through the recording control line 78.

Thereby, the AND gates G1–GN incorporated in the recording head 66 are operated and the switching transistors TR1–TRN are turned on and off by the AND output of the AND gates, and the heat generating members 13-1 to 13-N for the dots to be printed are selectively electrically energized to thereby execute image recording.

Figure 8:
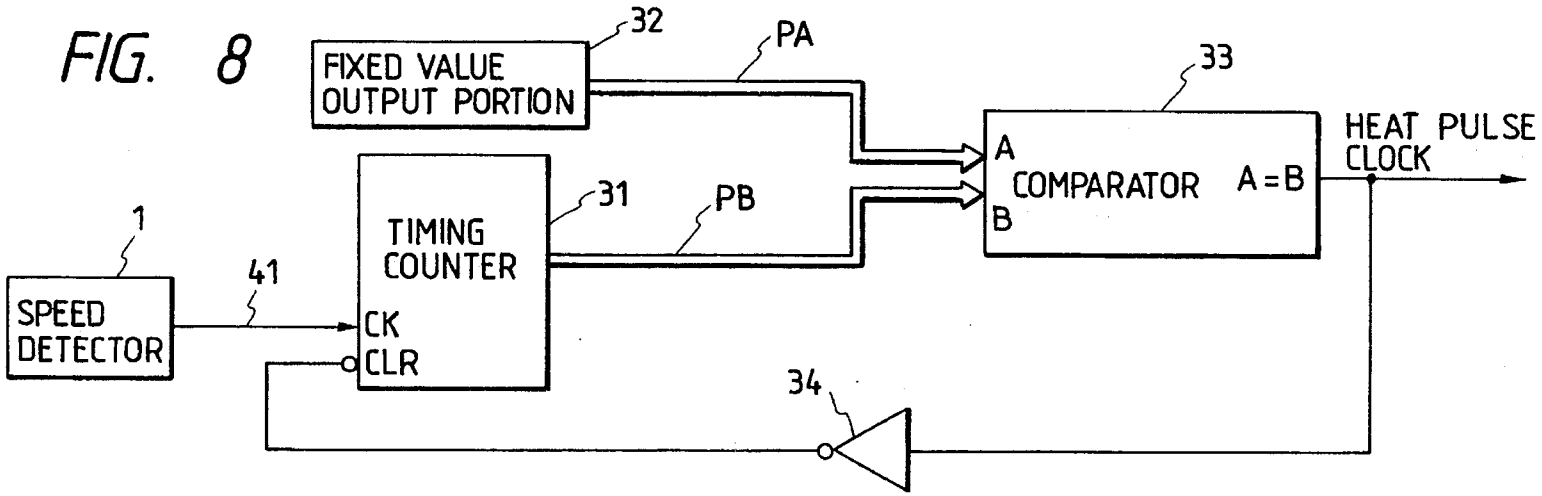
FIG. 8 is a block diagram illustrating the output timing of a heat pulse shown in FIG. 7.

FIG. 8 is a block diagram illustrating the output timing of the heat pulse HP shown in FIG. 7.

In FIG. 8, the reference numeral 31 designates a timing counter which counts pulse number N as a frequency f proportional to a speed v output from the speed detector 1 to detect the movement distance.

The reference numeral 32 denotes a fixed value output portion which outputs a pulse number PA (fixed value) per line to the input port A of a comparator 33. The comparator 33 outputs a heat pulse clock when the pulse number PA input to the input port A and the count value PB counted up from the timing counter 31 coincide with each other. The heat pulse HP of FIG. 7 is made of this heat pulse clock. An inverter 34 is operated by the heat pulse clock to clear the content of the timing counter 31.

Thereby, it becomes possible to output the heat pulse HP accurately each time the conveying belt 54 is moved by an amount corresponding to one line, even if there is a speed fluctuation in the conveying belt 54.

Figure 9A:
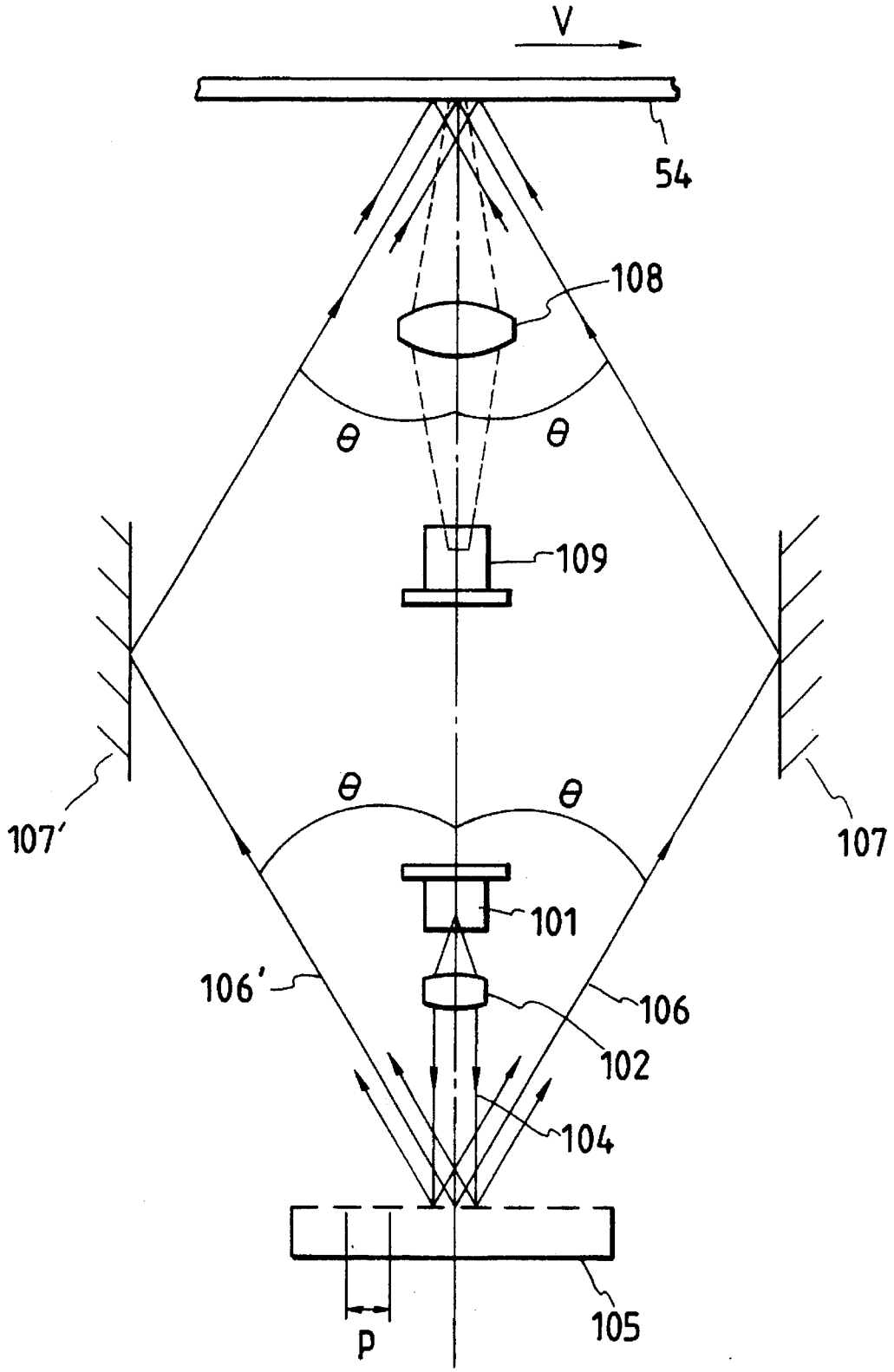
FIGS. 9A, 9B and 9C illustrate specific examples of the speed detector used in FIG. 3.

FIG. 9A illustrates a more preferred embodiment of the optical non-contact speed detector 1 used in the information recording apparatus according to the present invention, and more particularly a small laser Doppler speed detector using a semiconductor laser 101.

A laser beam oscillated from the semiconductor laser 101 is made into a parallel beam by a collimator lens 102 and enters a diffraction grating 105 perpendicularly thereto, and is separated into ±1st-order diffracted light 106 and 106', which in turn are reflected by mirrors 107 and 107', respectively, perpendicular to the diffraction grating 105, and are orthogonally applied onto the inner surface of the conveying belt 54. At this time, the angles of incidence onto the conveying belt 54 are each equal to the angle of diffraction θ by the diffraction grating 105, that is, $$\sin\theta = \pm\lambda/d, \tag{1}$$

where d is the grating pitch (constant) of the diffraction grating 105, and λ is the wavelength of the laser beam. As is clear from condition (1), the angle of incidence θ onto the conveying belt varies in conformity with a variation in the wavelength λ of the light from the light source and sin θ/λ is made constant. Scattered light from the orthogonally irradiated portion of the conveying belt 54 which has been subjected to Doppler shift is condensed on a light receiving device by a condensing lens 108. The output of the light receiving device 109 includes therein a frequency component $f_D$ which is the so-called Doppler frequency proportional to the speed V of the conveying belt 54, and this frequency component $f_D$ can be expressed as $$f_D=2V \sin \theta/\lambda, \quad (2)$$

but by the aforementioned condition (1) of diffraction, it becomes $$f_D=2V/d \quad (3)$$

and this does not depend on the wavelength λ of the laser, and laser Doppler speed detection proportional to the speed V of the conveying belt 54 becomes possible.

Figure 9B:
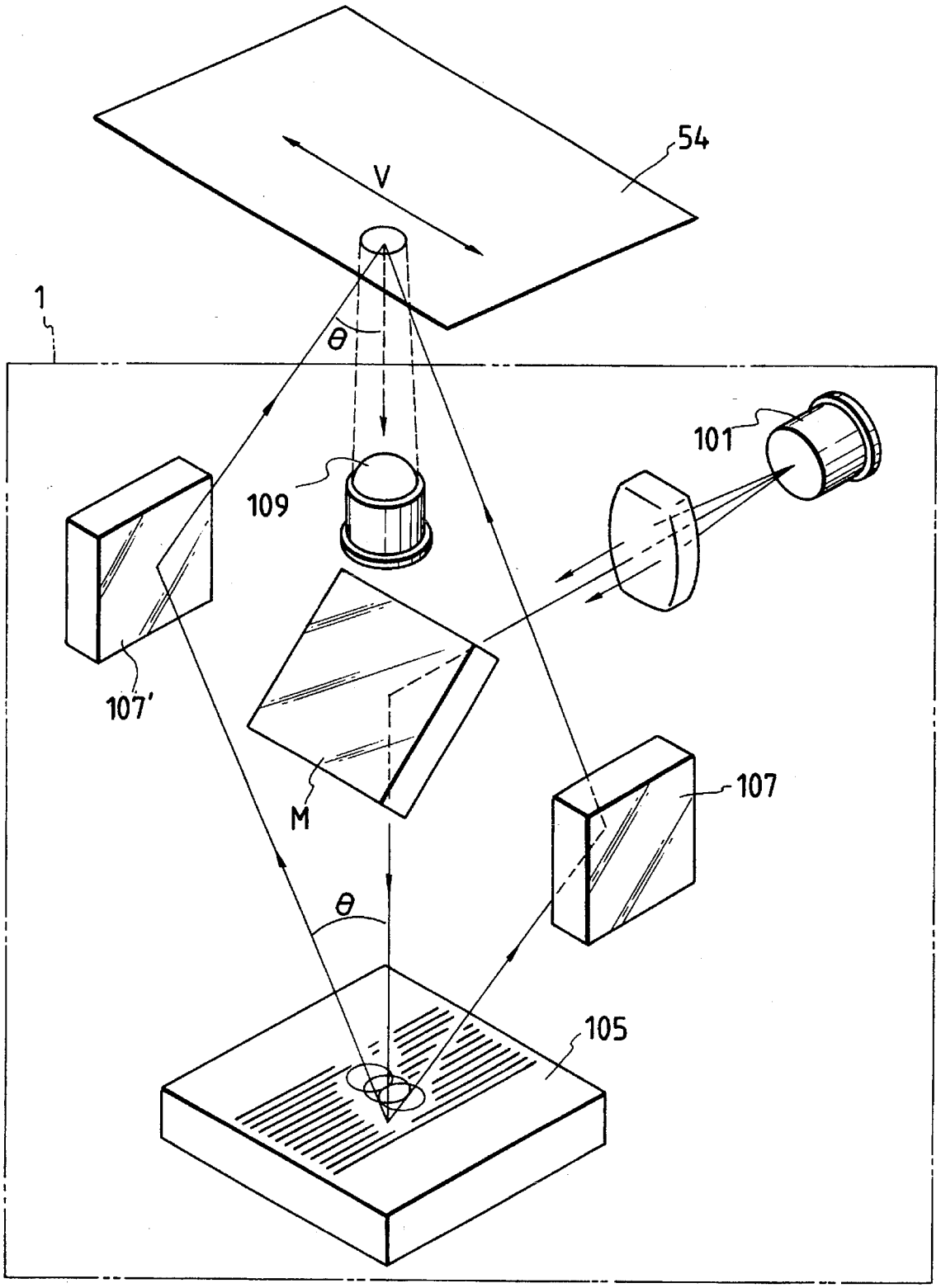

FIG. 9B shows a modification of the FIG. 9A embodiment in which the semiconductor laser 101 is disposed perpendicularly to the plane of the drawing sheet of FIG. 9A with a mirror M interposed between the conveying belt 54 and the diffraction grating 105.

Figure 9C:
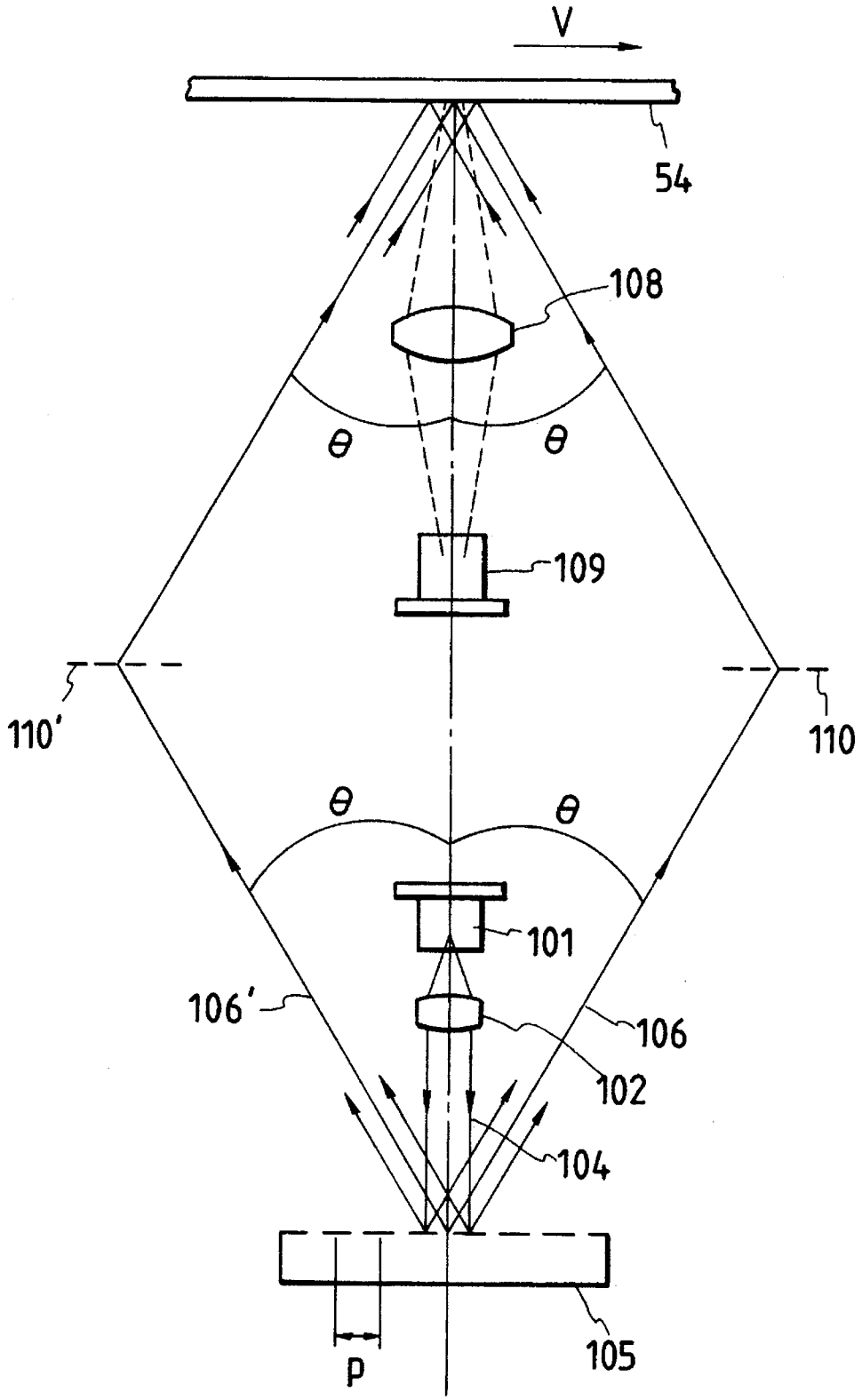

FIG. 9C shows an embodiment in which instead of mirrors 107 and 107', diffraction gratings 110 and 110' having ½ of the grating pitch of the diffraction grating 105 are disposed parallel to the diffraction grating 105 and use is made of the 1st-order diffracted light directed toward the center of the optical system, and the angles of incidence onto and the angles of diffraction of the diffraction gratings 110 and 110' are equal to each other and as in FIG. 9A, $$f_D=2V/d$$

is obtained. The diffraction gratings 110 and 110' may desirably be, for example, brazed diffraction gratings in which most of the diffracted light energy concentrates in a particular (in this case, the 1st-order diffraction toward the center of the optical system) order number.

The laser Doppler speed detector as shown in FIG. 9A, 9B or 9C wherein a light beam is split into two light beams by a diffraction grating so that the two light beams may enter the conveying belt at the same angle as the angle of diffraction can use a semiconductor laser and can be constructed of a diffraction grating and a simple optical system and can therefore be made compact, and can also output the speed of the conveying belt accurately as a frequency.

Thereby, image recording can be accomplished stably and accurately without affecting the conveyance of the recording medium and without being affected by stains on the surface of the conveying means caused by the recording liquid or the like, and image recording free of density irregularity, particularly, color image recording free of misregistration, irregularity of colors and bleeding of colors is possible.

Now, in the above-described embodiments, the speed detector is provided on the back side of the conveying means and as described above, speed detection can be accomplished without being affected by stains on the surface of the conveying means caused by the recording liquid or the like, and it never happens that erroneous detection is caused by the edge level difference portion on the leading end or the trailing end of the cut sheet 51.

The above embodiments have been described with respect to an information recording apparatus from which the recording liquid is discharged, where as the present invention is not restricted thereto, but may be an information recording apparatus which effects optical recording by a laser or the like.

A plurality of speed detectors may be provided in the widthwise direction of the recording medium or may be displaced in said direction, or the diffraction grating may be moved in the direction of conveyance of the recording medium to prevent so-called drop-out (nullification of signal) when the conveyance speed becomes low.

Alternatively, a plurality of speed detectors may be provided in the direction of conveyance of the recording medium.

Also, the speed detector may be made displaceable in a direction perpendicular to the recording surface of the recording medium so that the irradiating situation of the recording surface may be varied.

Now, in the above-described embodiments, the diffraction grating is designed such that ±1st-order diffracted light emerge therefrom, but use maybe ±nth-order diffracted light (n being a natural number). Also, use may be made of a method whereby one of two light beams is directed to a moving object and the other light beam which is not applied to the moving object and scattered light from the moving object is caused to interfere with each other to thereby obtain a Doppler signal.

Further, if the aforedescribed laser Doppler velocimeters are disposed orthogonally to each other, two-dimensional speed detection will become possible.

In the embodiments of FIGS. 3 and 8, it has been described that on the basis of the output of the speed detector 1, the timing counter 31 counts the pulse number N output as a frequency proportional to the speed and when this pulse number N coincides with the pulse number PA input to the input port A of the comparator 33, the heat pulse HP is output to thereby adjust the recording timing, but where there are two or more kinds of recording density and these can be selected, the above-mentioned input pulse number PA is set to a small value so as to shorten the movement distance for adjusting the recording timing when high recording density is selected.

Figure 10:
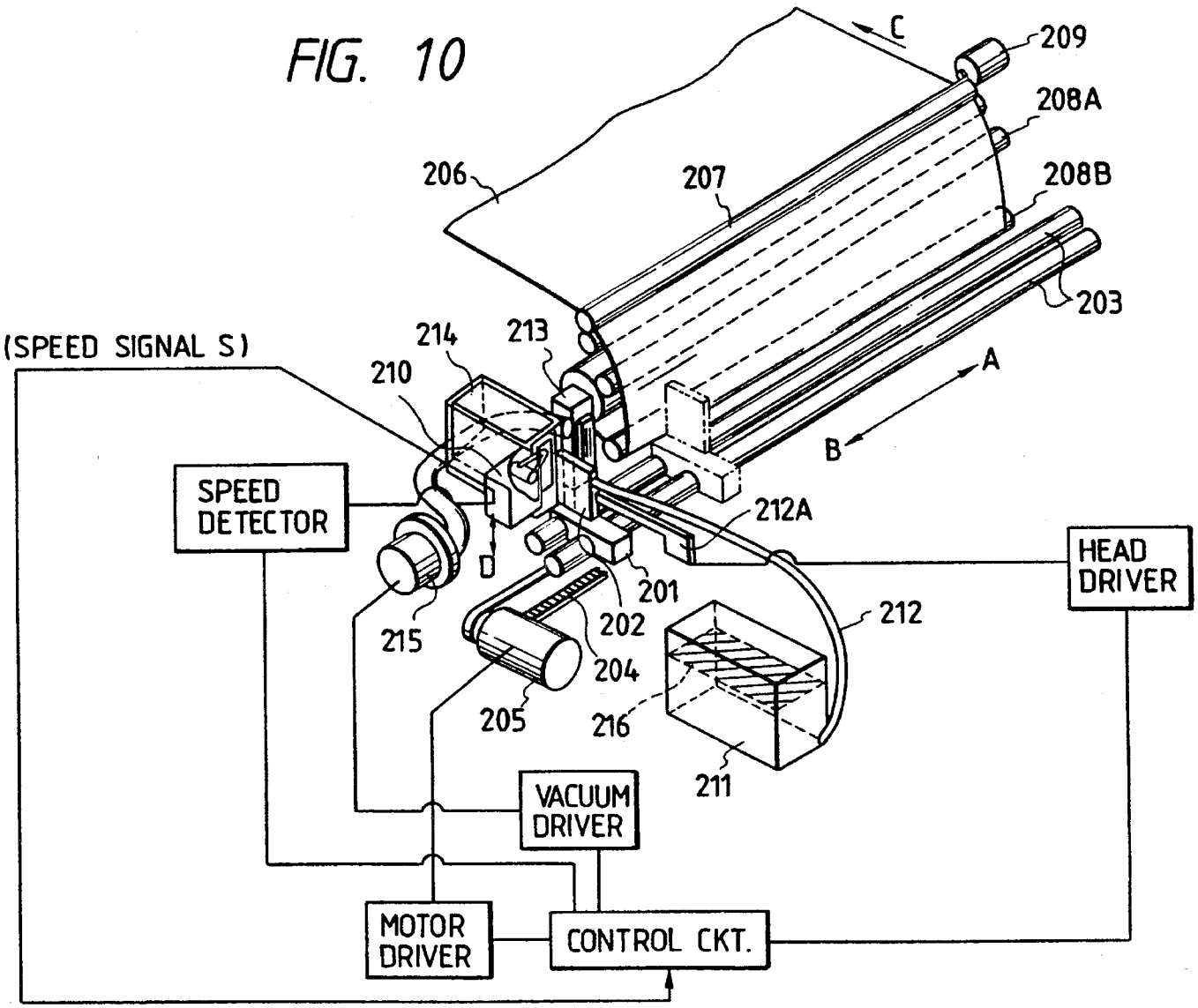
FIG. 10 illustrates a speed detector for detecting the discharge speed of a liquid droplet and a driving system therefor.

A speed detector for detecting the discharge speed of a liquid droplet and a driving system therefor will now be described with reference to FIG. 10. In FIG. 10, the reference numeral 201 designates a carriage carrying a recording head 202 thereon, and the reference numeral 203 denotes a guide rail for movably holding the carriage 201. An endless belt 204 is connected to the carriage 201, which is driven by a drive motor 205 and is moved along the recording surface of a recording sheet 206. The reference numeral 207 designates a roller for feeding the recording sheet 206, the reference characters 208A and 208B denote guide rollers for guiding the sheet 206, and the reference numeral 209 designates a sheet feeding motor.

On the other hand, the recording head 202 is formed with a discharge port, not shown, through which ink droplets are discharged toward the recording sheet 206, and ink 216 is supplied to the discharge port from an ink tank 211 through a supply tube 212, and an ink discharge signal is selectively supplied to discharge energy generating means, not shown, provided in the discharge port through a flexible cable 212A.

The reference numeral 213 denotes capping means for capping an orifice surface which provides the discharge port for recording liquid in the recording head 202 during non-recording, and this capping means 213 can be urged against the orifice surface by moving the carriage 201 in the direction of arrow during non-recording. The reason why the capping means 213 is provided is as follows.

Even during non-recording, ink may remain in the discharge port of the recording head and therefore, it is necessary to prevent the desiccation of the ink in the discharge port or the increased viscosity of the ink caused by evaporation, and for this purpose, provision is made of the so-called capping means for covering the orifice of the recording head with a lid during non-recording to thereby prevent the desiccation or evaporation of the ink.

Further, under low-humidity environment or during a long down-time, the increased viscosity of the ink may not be avoided by only the desiccation preventing means as described above and therefore, with the above-described capping means, use is made of a recovery mechanism which sucks the air in the cap covering the recording head and imparts negative pressure to the ink from the orifice and sucks out the ink stagnant in the discharge port of the head or imparts pressure to the interior of the discharge port by the use of a pump, thereby discharging the degenerated ink from the orifice.

That is, the capping means 213 is urged against the orifice surface and an air pump 215 is operated, whereby the ink in the discharge port of the recording head 202 can be sucked out.

The above-described recovery mechanism is automatically driven during the closing of the power switch, and is not driven usually during the recording operation unless there is considerable abnormality of discharge and therefore, there may occur the degeneration of the ink by the non-use of the discharge port during the recording operation. That is, in an apparatus wherein a plurality of discharge ports are provided in a recording head, there are orifices which are hardly used for recording from the statistical nature of recording data and therefore, there is irregularity in the discharge driving of the discharge ports, such as very much lengthened discharge intervals. Accordingly, the ink in the discharge ports when the frequency of discharge is small or discharge intervals are long suffers from an increase in viscosity caused by desiccation depending on the environmental conditions such as humidity and temperature and thus, the discharge of the ink from the discharge ports becomes unstable or the discharge becomes impossible.

So, during the recording operation, the recording head is moved to the non-recording position and the discharge of the ink is effected.

The reference numeral 214 designates an ink receiver for use during the idle discharge of the recording head 202.

Now, the reference numeral 210 denotes a compact Doppler speed detector for detecting the speed of an ink droplet discharged from the recording head 202, and this Doppler speed detector 210 is moved in the direction of arrow D by driving means, not shown, and detects the speed of the ink droplet in each nozzle of the recording head 202.

Figure 11:
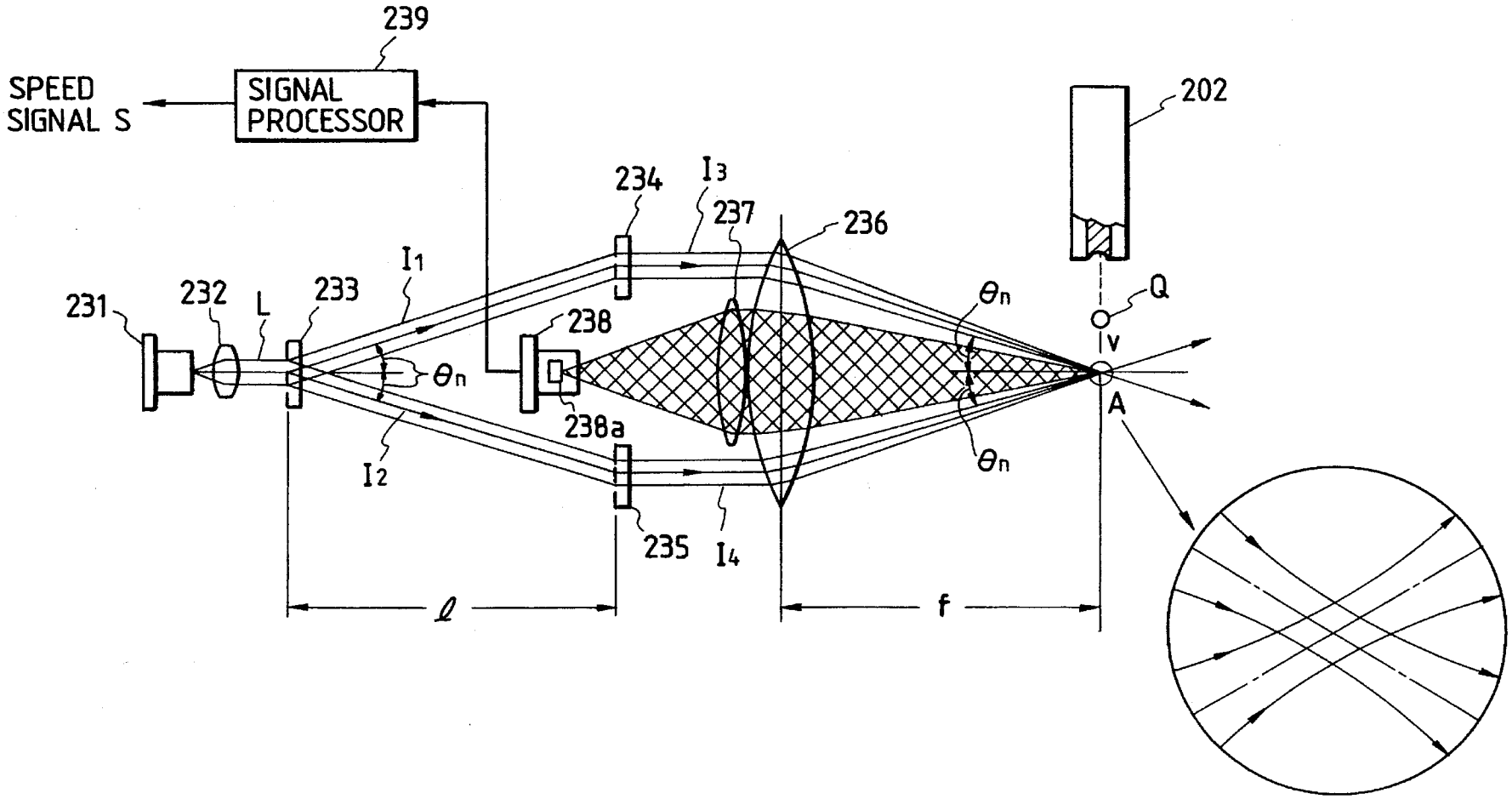
FIG. 11 shows a specific example of the speed detector for detecting the discharge speed of a liquid droplet.

FIG. 11 illustrates an example of a compact laser Doppler speed detector using a semiconductor laser (a laser diode).

A laser beam emitted from a laser diode 231 is converted into a parallel light beam by a collimator lens 232, and this parallel light beam enters the light receiving surface of a diffraction grating 233 perpendicularly thereto. The diffraction grating 233 diffracts the parallel light beam which has entered said light receiving surface perpendicularly thereto, and causes +1st-order transmitted diffracted light $I_1$ and −1st-order transmitted diffracted light $I_2$ to emerge at an angle of emergence (an angle of diffraction) $\theta_n$ so as to satisfy a diffraction condition $\sin \theta_n=\lambda/d$ . . . (1) (d is the pitch of the diffraction grating). The +1st-order diffracted light $I_1$ enters a second diffraction grating 234, and is diffracted thereby in a direction substantially parallel to the optic axes of lenses 237 and 236 and is directed in that direction. On the other hand, the −1st-order diffracted light $I_2$ enters a second diffraction grating 235, and is diffracted thereby in a direction substantially parallel to the optic axes of the lenses 237 and 236 and is directed in that direction.

Here, the ±1st-order diffracted light $I_1$ and $I_2$ are diffracted at the angle of diffraction $\theta_n$ by the second diffraction gratings 234 and 235, respectively. +1st-order diffracted light $I_3$ comprising parallel light from the diffraction grating 234 and −1st-order diffracted light $I_4$ comprising parallel light from the diffraction grating 235 follow optical paths parallel to each other and enter the marginal portion of the lens 236. The lens 236 deflects and condenses the ±1st-order diffracted light $I_3$ and $I_4$ which have entered this lens, and directs them to the focus position of the lens 236. Accordingly, the ±1st-order diffracted light $I_3$ and $I_4$ are superposed one upon the other at the focus position and form light spots. At this time, the angles of incidence of the ±1st-order diffracted light $I_3$ and $I_4$ onto the focus position are $\theta_n$, which is equal to the angle of emergence at which these diffracted light $I_3$ and $I_4$ emerge from the diffraction grating 233.

An ink droplet Q discharged from the recording head 202 crosses a position distant by a focal length f from the lens 236, i.e., the focus position, and therefore, spots formed by the ±1st-order diffracted light $I_3$ and $I_4$ are formed on the orbit of the ink droplet. The reflected scattered light from the ink droplet Q illuminated by the ±1st-order diffracted light $I_3$ and $I_4$ enters the lens 236 and becomes a parallel light beam, which is directed to the light receiving portion **238*a* of a light detector 238 through the lens 237. Interference light including the scattered light created by the illumination by the +1st-order diffracted light $I_3$ and the scattered light created by the illumination by the −1st-order diffracted light $I_4$ impinges on said light receiving portion 238*a*. The light detector 238** photoelectrically converts this interference light and outputs a signal conforming to the Doppler frequency.

The speed-detected ink droplet Q and the light receiving portion **238*a* of the light detector 238 are set optically conjugate with each other so that the lenses 237 and 236 may project the image of the ink droplet Q illuminated by the diffracted light $I_3$ and $I_4$ onto the light receiving portion 238*a* and therefore, the reflected scattered light created by the ink droplet Q impinges efficiently on the light receiving portion 238*a***.

The angle formed by the ±1st-order diffracted light $I_1$ and $I_2$ when they emerge from the diffraction grating 233 and the angle of intersection formed by the ±1st-order diffracted light $I_3$ and $I_4$ when they obliquely enter the ink droplet Q are equal to each other, and this angle of intersection varies in conformity with a variation in the frequency (wavelength $\lambda$) of the laser beam so as to satisfy $\sin \theta_n=\lambda/d$, i.e., $\sin \theta_n/\lambda=1/d$ (constant). That is, the angle of incidence $\theta_n$ onto the ink droplet Q varies in conformity with a variation in the wavelength $\lambda$ of the light from the light source, whereby $\sin \theta_n/\lambda$ is made constant.

Accordingly, as regards the Doppler frequency of the interference light, there is obtained an accurate signal which is not affected by the variation in the laser wavelength $\lambda$.

The signal processing of the Doppler signal received by the light detector 238 will now be described with reference to FIG. 12.

Figure 12A:
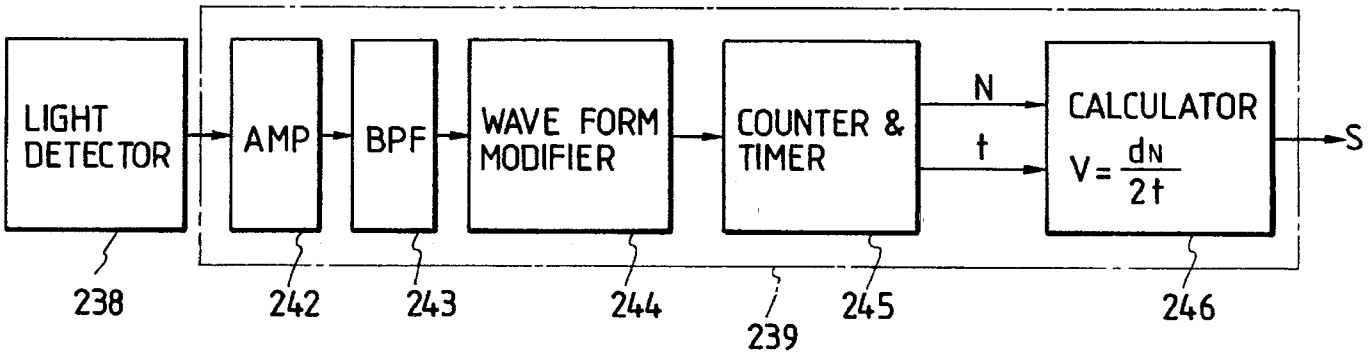
FIGS. 12A and 12B illustrate the signal processing of the speed detector.
Figure 12B:
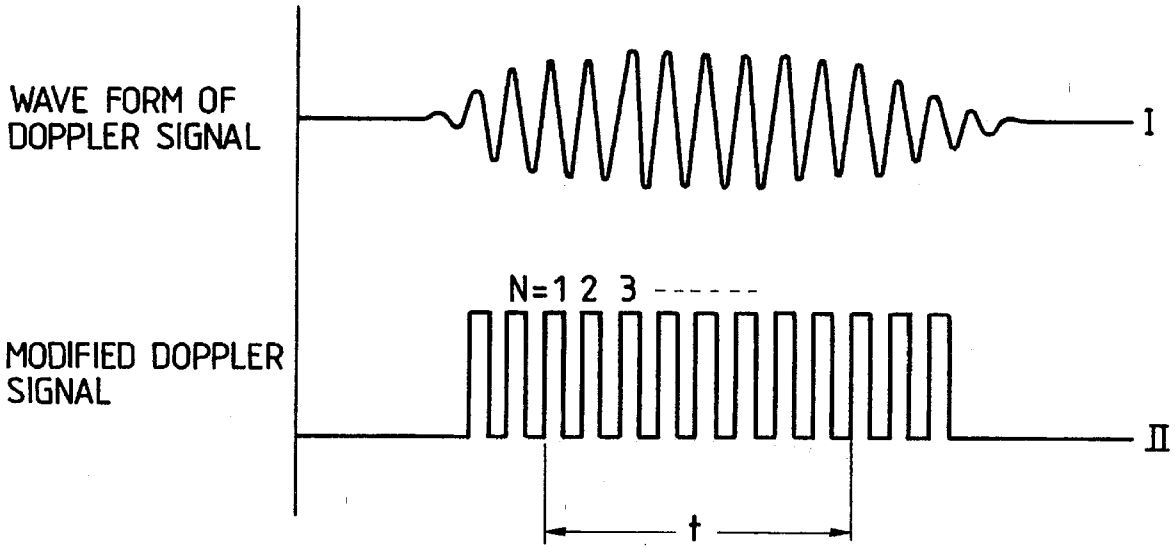

In FIG. 12A, the reference numeral 239 designates a signal processor. The Doppler signal from the light detector 238 is amplified by an amplifier 242, and the noise thereof is decreased by a band-pass filter (B.P.F.) 243 and the Doppler signal is made into a waveform as indicated by I in FIG. 12B, and is modified as a pulse wave as indicated by II in FIG. 12, by a waveform modifier 244. A counter and timer 245, when it detects the arrival of the Doppler signal, measures a pulse number N (an integer such as 8 or 10) and a time t conforming thereto. Here, the speed V, from equation (4) F=2V/d, is $$V=dF/2=dN/2t. \ (F=N/t)$$

So, a calculator 246 calculates the speed V from the values of N and t and outputs a speed signal S.

By the speed detector 210 described above, the discharge speed of the ink droplet Q from the recording head 202 is sequentially detected, and that speed signal S is sent to the control circuit in FIG. 10. If the speed signal S is outside a predetermined range, the purging operation such as idle discharge or suction recovery is performed in conformity with the degree thereof to thereby-bring about a normal state. The discharge speed of the ink droplet Q is detected and if it is within a predetermined range, image recording is started.

In the aforedescribed embodiment, the purging operation is performed when the speed signal S from the speed detector 210 is outside the predetermined range, but it is also possible to control heat energy by the electric power supplied to the heater 223 of the recording head 202, thereby bringing about a normal state. Means for controlling the heat energy includes a method of varying the applied pulse time and voltage or pre-applying a preliminary applied pulse.

Alternatively, the aforedescribed purging operation and the control of the heat energy may be combined together.

Figure 13:
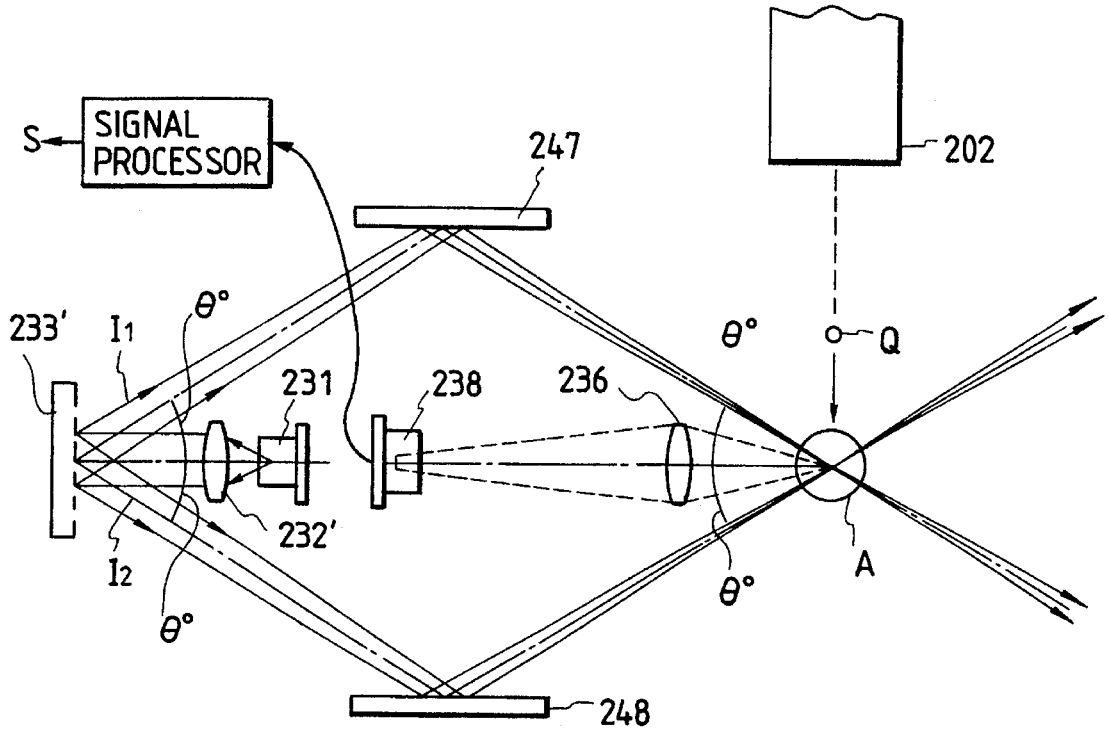
FIGS. 13 and 14 show different specific examples of the speed detector for detecting the discharge speed of a liquid droplet.
Figure 14:
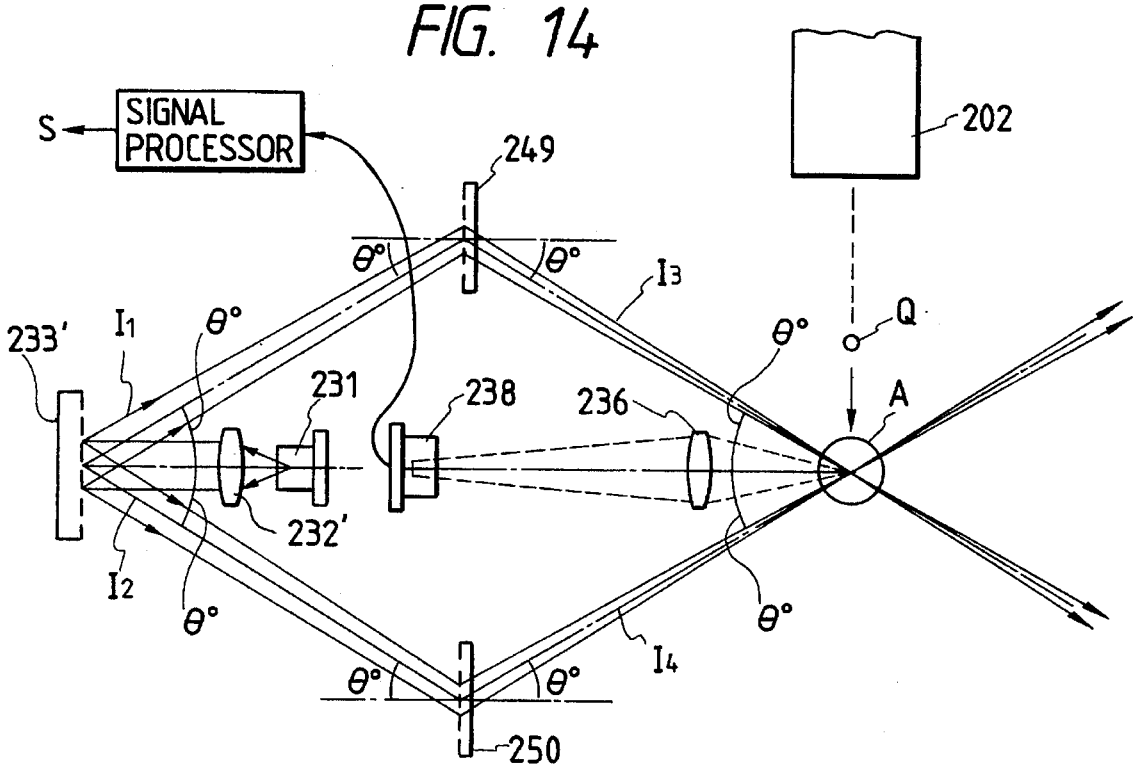

FIGS. 13 and 14 show other examples of the compact laser Doppler speed detector 210 in which the speed signal S does not depend on the laser wavelength λ.

In FIG. 13, a somewhat stopped-down laser beam I is caused to enter a reflection type diffraction grating 233' having a grating pitch d perpendicular to the direction of arrangement of the grating, and is split into ±1st-order diffracted light $I_1$ and $I_2$, and the two light beams $I_1$ and $I_2$ are turned back by parallel mirrors 247 and 248 so that both of the two light beams may be converged at the point of intersection therebetween. The portion A, if enlarged, will become similar to FIG. 11. A semiconductor laser 231 and a lens 232' are used as the laser source and the converging system, respectively, and the lens 232' is set so that both of the two light beams may be converged at the point of intersection.

Accordingly, again by the construction of FIG. 13, there can be obtained a signal whose Doppler frequency is not affected by any variation in the wavelength of the laser beam.

Here, when the spacing between the mirrors 247 and 248 is $\underline{l}$, the distance h from the diffraction grating and the point of intersection between the two light beams is $$h = \underline{l} \times \sqrt{(d^2 - \lambda^2)/\lambda} \quad .$$

That is, if the wavelength varies, the position of intersection also varies somewhat, but if the speed detector is made compact and $\underline{l}$ is made small, the position of intersection will hardly deviate, and if a simple temperature adjusting system is used, the position of intersection will hardly vary and will become sufficiently practically usable.

FIG. 14 shows a laser Doppler speed detector incorporating therein transmission type diffraction gratings 249 and 250 having a grating pitch d/2, in lien of the mirrors 247 and 248 of FIG. 13, and in FIG. 14, the other members are the same as those shown in FIG. 13 and are given the same reference numerals as those in FIG. 13. In FIG. 14, two diffracted light beam $I_1$ and $I_2$ from a reflection type diffraction grating 233' are further transmitted through transmission type diffraction gratings 249 and 250, respectively, and are both converged at the point of intersection therebetween. The portion A, if enlarged, will become similar to FIG. 11. As in FIG. 13, a semiconductor laser 231 and a lens 232' are used as the laser source, and the lens 232' is set so as to converge both of the two light beams at the point of intersection therebetween.

In the embodiment of FIG. 14, the position of intersection between the two light beams is immovable.

Figure 15A:
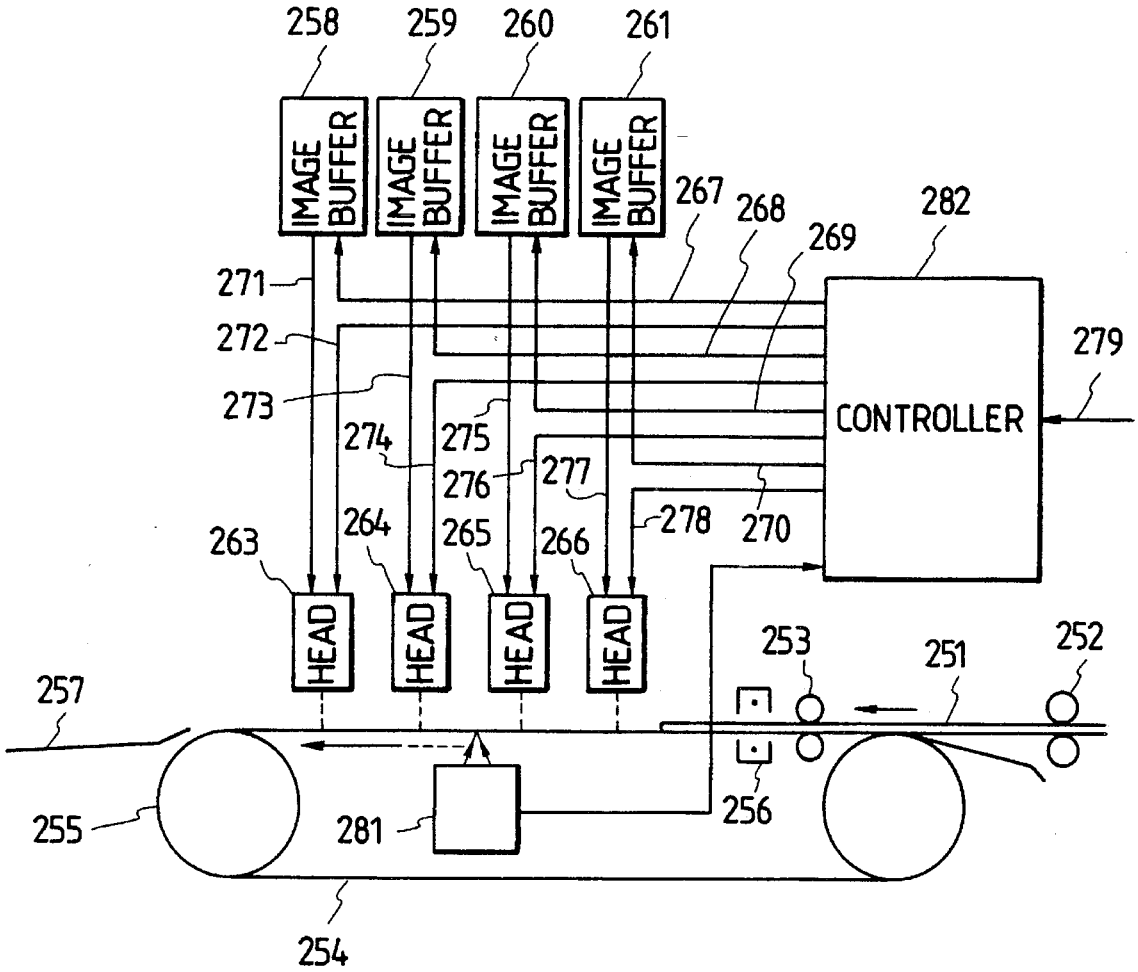
FIGS. 15A and 15B are schematic diagrams of an embodiment for controlling the discharge speed of a liquid droplet and the conveyance speed of recording paper.

FIGS. 15A and B show an embodiment which effects the control of the discharge speed of the recording liquid and the control of the conveyance speed of recording paper.

In FIG. 15(A), the reference numeral 251 designates a cut sheet which is a recording medium and which is conveyed in the direction of arrow after the writing timing in the sub-scanning direction is taken by register rollers 252.

The reference numeral 253 denotes a paper keep roller which limits the movement of the cut sheet 251 placed on a conveying belt 254. The reference numeral 255 designates a driving roller on which the conveying belt 254 is wound with predetermined tension. The reference numeral 256 denotes a charger which causes the cut sheet 251 on the conveying belt 254 to be electrostatically attracted to the conveying belt 254.

The reference numeral 257 designates a paper discharge tray onto which the cut sheet 251 subjected to the recording process is discharged. The reference numeral 258–261 denote image buffers storing recording information data therein. Color data corresponding to yellow, magenta, cyan and black for reproducing a color image are stored in the image buffers 258–261 on the basis of a writing control signal from a controller 282. The controller 282 reads out various color data from the image buffers 258–261 at predetermined intervals after the register rollers 252 are driven, and outputs them to recording heads 263–266 of the full line type, thereby recording respective color images on the cut sheet 251. The reference numerals 267–270 designate memory control lines which transfer the writing control signal from the controller 282 to the image buffers 258–261. The reference numerals 271, 273, 275 and 277 denote data lines which transfer the respective color data read out from the image buffers 258–261 to the recording heads 263–266. The reference numerals 272, 274, 276 and 278 designate recording control lines which transfer a recording timing signal output from the controller 282 to the recording heads 263–266.

The reference numeral 279 denotes a start signal which is output from a host, not shown.

The recording operation will now be described.

In a recording apparatus wherein the plurality of recording heads 263–266 are disposed like this, when the cut sheet 251 is fed after the image recording timing in the sub-scanning direction is taken by the register rollers 252, the cut sheet 251 is attracted to the conveying belt 254 by the charger 256 and is conveyed. When together with this, a recording operation start command is output to the controller 282 by a start signal 279, image data (color data) is read out from the image buffer 261 to the recording head 266 which is a first recording head at a timing for effecting recording from the head of the cut sheet 251, and recording is started on the cut sheet 251 by the recording head 266.

Likewise, to the recording heads 265–263 which are second to fourth recording heads, a timing corresponding to the distance to the immediately preceding head is taken, and image data read out from the image buffers 260–258 for respective colors are recorded on the cut sheet 251 by the recording heads 265–263 for respective colors, and as a result, a full color image is formed on the cut sheet 251, which is thus discharged onto the paper discharge tray 257.

Figure 15B:
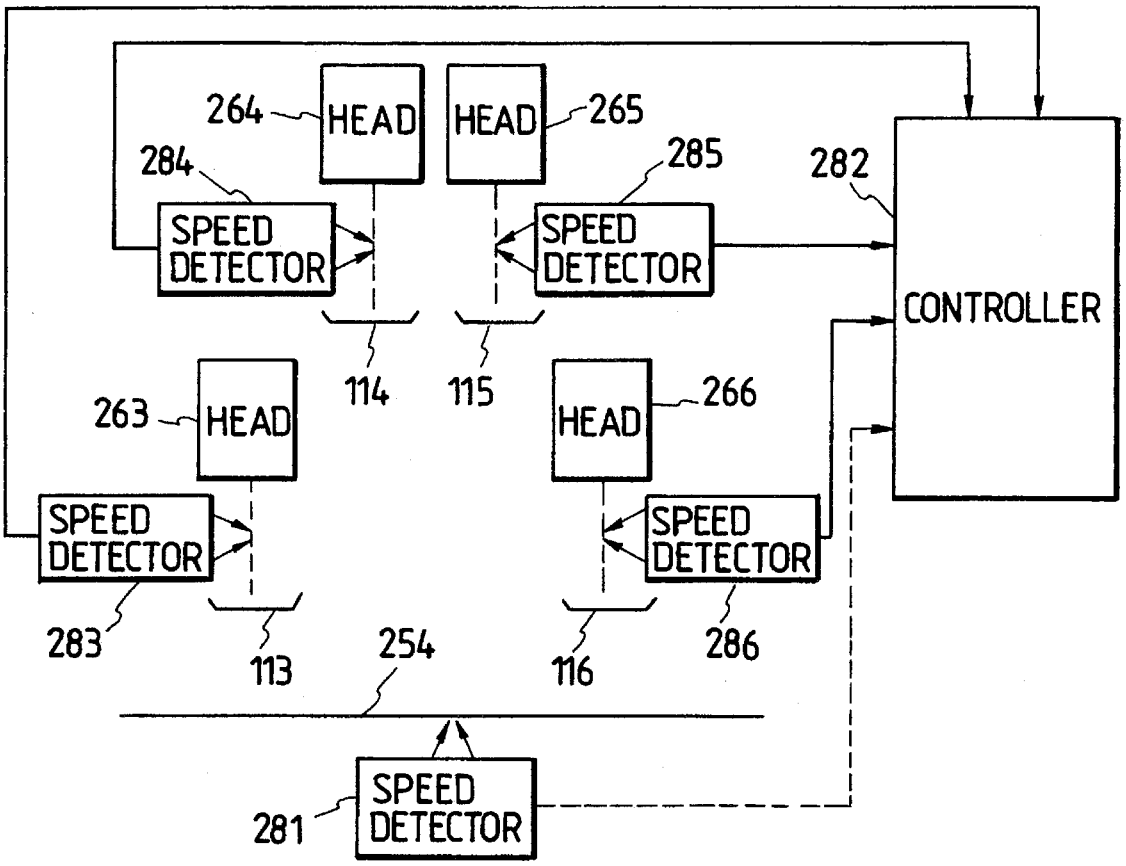

Now, as shown in FIG. 15(B), during non-recording, the recording heads 263, 264, 265 and 266 are displaced, for example, upwardly so that the discharge speed of the liquid droplet may be measured by the above-described Doppler type speed detectors 283, 284, 285 and 286. The speed detectors 283, 284, 285 and 286 are provided in the direction of recording width (the direction perpendicular to the plane of the drawing sheet), and the result of the measurement of the discharge speed of the liquid droplet from each recording head is input to and stored in the controller 282. The reference numerals 113, 114, 115 and 116 designate liquid receivers.

During recording, the conveyance speed condition of the recording paper electrostatically attracted to the conveying belt as shown in Figure 15A is detected by a laser Doppler type speed detector 281. This speed detector 281 is provided at a position upstream of the driving roller 255 and substantially central in the widthwise direction of the conveying belt 254 on the inner peripheral side of the conveying belt 254, and the output signal thereof is input to the controller 282.

The controller 282 serves also as recording timing adjusting means, and when the speed detector 281 detects the conveyance speed of the conveying belt 254 which is conveying means, the controller 282 calculates the movement distance of the conveying belt 254 from the output of the speed detector 281 as previously described, and makes the image writing timing of the recording heads 63–66. The registrations of the respective color images are made coincident with one another so that regular image writing can be effected without resorting to the irregularity of the speed of the conveying belt 254, whereby there is formed an image free of density irregularity, color irregularity and bleeding of colors.

Figure 16A:
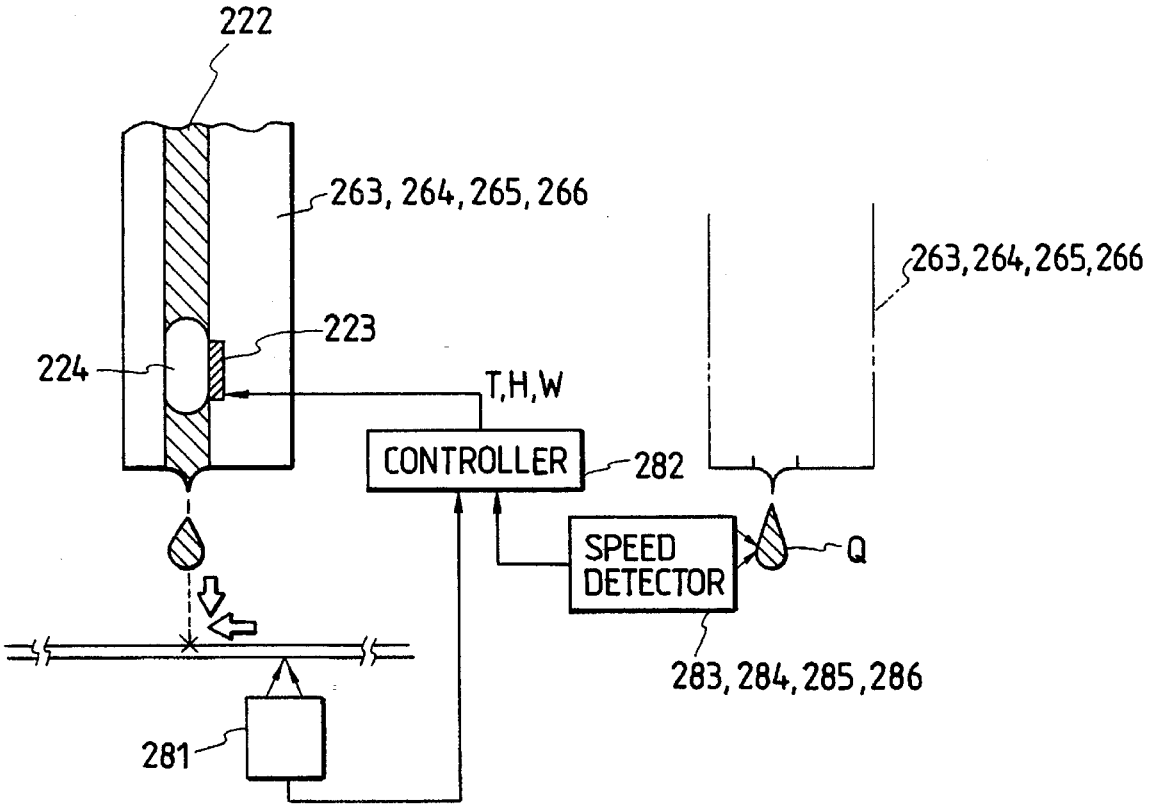
FIGS. 16A and 16B illustrate liquid droplet discharge timing control and liquid droplet discharge energy control, respectively.

FIG. 16(A) illustrates that the discharge speed of the liquid droplet is detected before recording (during non-recording) and the conveyance speed condition is detected during recording to thereby adjust the timing T of the liquid droplet discharge and control is effected on the basis of the discharge speed data of the liquid droplet memorized before recording so that the discharge speed of the liquid droplet during recording may assume a predetermined value.

When the liquid droplet discharge speed detected is not a predetermined speed, the control of the purging operation is effected before recording and the control of liquid droplet discharge energy is effected so that the liquid droplet discharge speed may be a predetermined speed during recording.

Figure 16B:
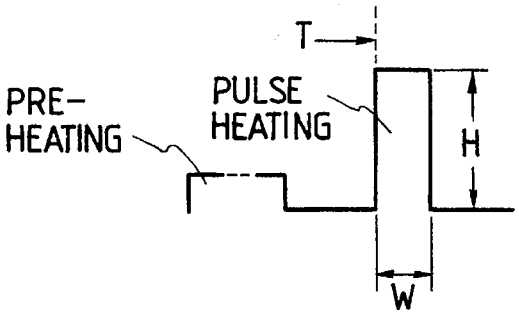

As the control of the liquid droplet discharge energy, there is a method of varying an applied pulse time W and voltage H as shown in FIG. 16(B) or pre-applying a preliminary applied pulse.

According to the present embodiment, when the location on the recording paper at which recording is desired comes just beneath a recording head, the liquid droplet from the recording head can be made to adhere to just said location.

Positions 284, 285 and 286 are not restricted to the positions in the above-described embodiment.

Also, the speed detectors 283, 284, 285 and 286 may be designed to prevent so-called drop-out (nullification of signal) when the diffraction grating is moved in the direction of movement of the object to be measured and the conveyance speed becomes low.

The speed detectors 283, 284, 285 and 286 may be made displaceable in a direction perpendicular to the surface to be inspected and the irradiating situation for the surface to be examined may be varied.

Now, in the above-described embodiments, the diffraction grating is designed to cause ±1st-order diffracted light to emerge therefrom, but ±nth-order diffracted light (n being a natural number) may also be used, and use may also be made of a reference light method of applying one of two light beams to a liquid droplet and causing the other light beam which is not applied to the liquid droplet to interfere with scattered light from the liquid droplet to thereby obtain a Doppler signal.

Further, if flow speed meters comprising the afore-described laser Doppler speed detectors are disposed orthogonally to each other, two-dimensional speed detection will become possible and not only the discharge speed of the ink droplet Q, but also the perpendicularity of the discharge direction can be detected and a more appropriate discharge condition can be detected.

Now, the present invention brings about an excellent effect in a recording head and recording apparatus of the ink jet recording type, particularly of the bubble jet type.

As regards the typical construction and principle thereof, the basic principle disclosed, for example, in U.S. Pat. Nos. 4,723,129 and 4,740,796 is preferable. This system is applicable to both of the so-called on-demand type and continuous type, and particularly, in the case of the on-demand type, it is effective because at least one driving signal corresponding to recording information and providing a rapid temperature rise exceeding nucleate boiling is applied to an electro-thermal conversion member disposed correspondingly to a sheet or a liquid path retaining liquid (ink) therein to thereby generate heat energy in the electro-thermal conversion member with a result that a bubble in the liquid (ink) corresponding at one to one to the driving signal can be formed. By the growth and shrinkage of this bubble, the liquid (ink) is discharged through a discharge opening to thereby form at least one droplet. If this driving signal is made into a pulse shape, the growth and shrinkage of the bubble take place appropriately on the spot and therefore, the discharge of the liquid (ink) excellent particularly in responsiveness can be achieved, and this is more preferable. This pulse-shaped driving signal may suitably be one as described in U.S. Pat. Nos. 4,463,359 and 4,345,262. The adoption of the conditions described in U.S. Pat. No. 4,313,124 which discloses an invention relating to the rate of temperature rise of the heat-acting surface will lead to the possibility of accomplishing more excellent recording.

As the construction of the recording head, besides the combined construction of a discharge port, a liquid path and an electro-thermal conversion member as disclosed in the above-mentioned publications (a straight liquid flow path or a right-angled liquid flow path), the construction using U.S. Pat. Nos. 4,558,333 and 4,459,600 which disclose a construction in which the heat-acting portion is disposed in a crooked area is also covered by the present invention. In addition, the present invention is also effective when use is made of a construction based on Japanese Laid-Open Patent Application No. 123670/1984 which discloses a construction in which a slit common to a plurality of electro-thermal conversion member provides the discharge portion of the electro-thermal conversion members or Japanese Laid-Open Patent Application No. 138461/1984 which discloses a construction in which an opening for absorbing the pressure wave of heat energy is made to correspond to a discharge portion.

Further, the recording head of the full line type having a length corresponding to the width of the largest recording medium on which a recording apparatus can effect recording may use any of the construction as disclosed in the above-mentioned publications wherein that length is satisfied by a combination of a plurality of recording heads and the construction as a unitarily formed recording head, and the present invention can display the above-described effect more effectively.

In addition, the present invention is also effective when use is made of a recording head of the interchangeable chip type which, by being mounted on an apparatus body, becomes electrically connectable to the apparatus body or can be supplied with ink from the apparatus body, or a recording head of the cartridge type in which a cartridge is provided integrally with the recording head itself.

Also, the addition of recovery means, preliminary auxiliary means, etc. for the recording head which is provided as the construction of the recording apparatus of the present invention is preferable because it can more stabilize the effect of the present invention. More specifically, capping means, cleaning means and pressing or suction means for the recording head, pre-heating means using an electro-thermal conversion member or a heating element discrete therefrom or a combination of these, and a preliminary discharge mode for effecting discharge discrete from recording are effective to accomplish stable recording.

Further, the recording mode of the recording apparatus is not limited to a recording mode for the main color such as black, but the recording head may be constructed as a unit or may be provided by a combination of a plurality of heads, and the present invention is also very effective for an apparatus provided with at least one of plural different colors and full color by mixed colors.

The above embodiments of the present invention have been described as using liquid ink, but in the present invention, use can also be made of ink which assumes a solid state at room temperature, and ink which assumes a softened state at room temperature. In the above-described ink 3et apparatus, it is usual to temperature-control the ink itself within the range of 30° C. to 70° C. so that the viscosity of the ink may be within a stable discharge range and therefore, use can be made of any ink which assumes the liquid phase when a recording signal used is imparted to the ink. In addition, the temperature rise by heat energy may be prevented by being positively used as the energy of the phase change of the ink from its solid state to its liquid state, or use may be made of any ink which solidifies when left as it is for the purpose of preventing the evaporation of the ink, and in any case, the use of ink having the nature of being liquefied only by heat energy, such as ink which is liquefied by heat energy being imparted thereto in conformity with a recording signal and is discharged in the form of liquid, or ink which already begins to solidify at a point of time whereat it arrives at a recording medium is also applicable to the present invention. In such a case, the ink may be in a form in which, as described in Japanese Laid-Open Patent Application No. 56847/1979 or No. 71260/ 1985, it is opposed to an electro-thermal conversion member while being retained as liquid or a solid in the recesses or through-holes of a porous sheet. In the present invention, what is most effective for the above-described inks is to execute the above-described film boiling system.

We claim:

1. An information recording apparatus having:

recording means for recording information on a recording medium having a front surface, on the basis of recording information data, said recording means effecting recording by discharging a liquid for recording onto said recording medium;

conveying means for conveying said recording medium with the front surface thereof opposed to said recording means so that said recording means records information on the front surface of the recording medium;

photodetection speed detecting means for photodetecting light from a back side of the front surface of the recording medium to detect a conveyance speed condition of the recording medium, said photodetection speed detecting means including a light source for generating said light and a detector for photodetecting said light, said light source and said detector being arranged in the back side of the front surface of the recording medium, a position where the conveyance speed is detected by said photodetection speed detecting means being located at substantially a back side of a position where said recording means discharges said liquid onto said recording medium; and control means for adjusting a recording position on the basis of conveyance speed information detected by said speed detecting means.

2. An information recording apparatus according to claim 1, wherein said control means adjusts the recording timing of said recording means.

3. An information recording apparatus according to claim 1, wherein said control means adjusts the recording position, by keeping the conveyance speed of said recording medium constant.

4. An information recording apparatus according to claim 2, wherein said control means is provided with calculating means for counting a pulse number output as a frequency proportional to the speed on the basis of the output of said speed detecting means and calculating movement distance information, and adjusts the recording timing of said recording means when the pulse number counted by said calculating means reaches a predetermined pulse number.

5. An information recording apparatus according to claim 1, wherein said speed detecting means is an optical Doppler velocimeter.

6. An information recording apparatus according to claim 5, wherein said speed detecting means is provided, in succession along an optical path, with a light source, a diffraction grating, an optical system for varying the angle of incidence $\theta$ of $\pm n$th-order light ($n$ being an integer ) diffracted by said diffraction grating onto said conveying means in conformity with the wavelength $\lambda$ of the light from said light source and making $\sin \theta/\lambda$ substantially constant, and a light detector for detecting Doppler-shifted scattered light from the speed-detected position of said conveying means.

7. An information recording apparatus according to claim 1, wherein said conveying means comprises an endless carrier having a thickness and wound with said recording medium being placed on the outer peripheral side of said endless carrier, and said speed detecting means is provided in opposed relationship with a predetermined location on the inner peripheral side of said endless carrier.

8. An information recording apparatus according to claim 4, wherein a plurality of recording densities can be selected, and when a high recording density is selected, said control means selects a small set pulse number so as to shorten said movement distance which adjusts the recording timing.

9. An information recording apparatus according to claim 1, wherein said recording means applies light in a direction intersecting the direction of conveyance of the recording medium and effects recording.

10. An information recording apparatus having:

recording means for recording information on a recording medium having a front surface, said front surface having a back side, on the basis of recording information data;

conveying means for conveying said recording medium with the front surface thereof opposed to said recording means so that said recording means records information on the front surface of the recording medium;

photodetection speed detecting means for photodetecting light from the back side of the front surface of the recording medium to detect a conveyance speed condition of the recording medium, said photodetection speed detecting means including a light source for generating said light and a detector for photodetecting said light, said light source and said detector being arranged in the back side of the front surface of the recording medium; and control means for adjusting a recording position on the basis of conveyance speed information detected by said speed detecting means, wherein said recording means applies light in a direction intersecting the direction of conveyance of the recording medium and effects recording, and wherein said recording medium is silver halide film, and said speed detecting means applies light to the non-emulsion surface of said silver halide film which is the back surface of said silver halide film and detects the conveyance speed condition.

11. An information recording apparatus according to claim 1, wherein said recording means effects recording by discharging liquid by a heat generating member, and said control means controls the timing of the liquid discharge of said recording means.

12. An information recording apparatus according to claim 1, wherein said recording means is provided with a plurality of recording heads corresponding to respective colors in the direction of conveyance of said conveying means, each of said recording heads discharges liquid by a heat generating member, and said control means controls the timing of the liquid discharge of each of said recording heads.

13. An information recording apparatus according to claim 6, wherein said light source is a semiconductor laser.

14. An information recording apparatus comprising:

a recording head for recording information on a recording medium on the basis of recording information data, said recording head effecting recording by discharging a liquid for recording on said recording medium;

a conveying system for conveying the recording medium with the front surface thereof opposed to said recording head so that said recording head records information on the front surface of the recording medium;

a velocity detecting system for photodetecting light from the back side of the front surface of the recording medium to detect the conveyance speed condition of the recording medium, said velocity detecting system including a light source for generating said light and a detector for photodetecting said light, said light source and said detector being arranged in the back side of the front surface of the recording medium, a position where the velocity is detected by said velocity detecting system being located at substantially a back side of a position where said recording head discharges said liquid for recording onto said recording medium; and a controller for adjusting the recording position on the basis of conveyance velocity information detected by said velocity detecting system.

15. An information recording apparatus comprising:

a recording system for causing recording liquid to be discharged therefrom onto a recording medium based on recording information data to effect recording, said recording system having a plurality of heads each for discharging liquid droplets;

a conveying system for conveying the recording medium;

a first speed detecting system for detecting the discharge speed condition of the liquid droplet discharged from said recording system, said first speed detecting system having at least one detecting unit for detecting the discharge speed condition of the liquid droplet discharged from respective one of said plurality of heads;

a second speed detecting system for detecting the conveyance speed condition of the recording medium, said second speed detecting system including a light source for generating a light for speed detection and a detector for photodetecting said light for speed detection, said light source and said detector being arranged in the back side of the front surface of the recording medium, a position where the speed is detected by said second speed detecting system being located at substantially a back side of a position where said recording system discharges said liquid for recording onto said recording medium; and control means for adjusting an adhering position of the liquid droplet discharged from said recording head onto the recording medium on the basis of the outputs of said first and second speed detecting systems so that recording is performed at a preferred position on the recording medium.

16. An apparatus according to claim 1, wherein said conveying means has a belt for conveyance, and said speed detecting means photo-detects light from said belt which exists in the back side of the front surface of the recording medium.

17. An apparatus according to claim 14, wherein said conveying system comprises a belt for conveyance, and said velocity detecting system photo-detects light from Said belt which exists in the back side of the front surface of the recording medium.

* * * * *

UNITED STATES PATENT AND TRADEMARK OFFICE

CERTIFICATE OF CORRECTION

PATENT NO. : 5,589,858

DATED : December 31, 1996

INVENTORS : HIDEJIRO KADOWAKI ET AL.

It is certified that error appears in the above-identified patent and that said Letters Patent is hereby corrected as shown below:

COLUMN 5

Line 25, "direction," should read --direction)--.

COLUMN 13

Line 7, "thereby-bring" should read --thereby bring--;
Line 55, "lien" should read --lieu--;
Line 59, "beam" should read --beams--.

COLUMN 17

Line 27, "3et" should read --jet--.

UNITED STATES PATENT AND TRADEMARK OFFICE

CERTIFICATE OF CORRECTION

PATENT NO. : 5,589,858

DATED : December 31, 1996

INVENTORS : HIDEJIRO KADOWAKI ET AL.

It is certified that error appears in the above-identified patent and that said Letters Patent is hereby corrected as shown below:

COLUMN 20

Line 47, "Said" should read --said--.

Signed and Sealed this

Twenty-fourth Day of June, 1997

Bruce Lehman

*Attest:*

BRUCE LEHMAN

*Attesting Officer*

*Commissioner of Patents and Trademarks*